US005371903A

United States Patent [19]

Lew

[11] Patent Number: 5,371,903

[45] Date of Patent: Dec. 13, 1994

[54] AERODYNAMIC MODULES FOR CYCLING, SKATING AND OTHER SPEED SPORTS

[75] Inventor: Paul E. Lew, Carmel, Ind.

[73] Assignee: Wear and Tear, Inc., Indianapolis, Ind.

[21] Appl. No.: 21,151

[22] Filed: Mar. 8, 1993

Related U.S. Application Data

[63] Continuation-in-part of Ser. No. 851,812, Mar. 16, 1992, abandoned.

[51] Int. Cl.[5] ..... A41D 13/00

[52] U.S. Cl. ..... 2/16; 2/1; 2/88; 2/267; 36/115

[58] Field of Search ..... 2/88, 2, 16, 1, 177, 2/175, 196, 267, 59, 410, 425; 224/222, 224, 226, 267; 280/290, 288.2, 288.4, 841, 11.19, 11.3, 809, 810, 811, 24, 32.7; 36/132, 115, 136

[56] References Cited

U.S. PATENT DOCUMENTS

| | | | |
|---|---|---|---|
| 1,677,187 | 7/1928 | Leibson . | |
| 3,936,075 | 2/1976 | Jelliffe . | |
| 4,193,134 | 3/1980 | Hanrahan et al. . | |
| 4,599,747 | 7/1986 | Robinson . | |
| 4,901,898 | 2/1990 | Colombo et al. . | |
| 5,106,331 | 4/1992 | Lizarazu | 441/55 |

FOREIGN PATENT DOCUMENTS

| | | | |
|---|---|---|---|
| 370553 | 3/1923 | Germany | 2/410 |
| 671864 | 6/1988 | Switzerland | 2/410 |

*Primary Examiner*—Clifford D. Crowder
*Assistant Examiner*—Gloria Hale
*Attorney, Agent, or Firm*—Baker & Daniels

[57] ABSTRACT

Aerodynamic enhancements and modules for cycling and other speed sports such as skating and skiing include in one embodiment a wind drag reducer including two tapered arm/leg wedges. For cycling the the tapered wedges which are held in position by a stretch fabric sleeve, are worn on the upper arm area. For speedskating the tapered wedges are placed around the calf and a slightly modified wedge is attached to the heel of the speed skating boot. Another type of wind drag reducer includes a contoured rear spoiler board which is strapped to the back of a cyclist. An aerodynamic module to improve laminar air flow according to another embodiment includes a pod with a forwardly protruding nose-cone shaped front surface. The pod is held in position around the cyclist by a stretch fabric sleeve and strap arrangement.

19 Claims, 20 Drawing Sheets

Fig. 20
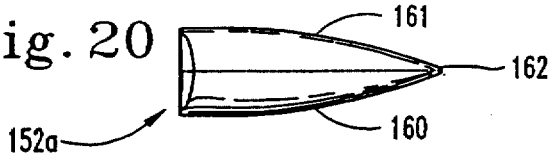
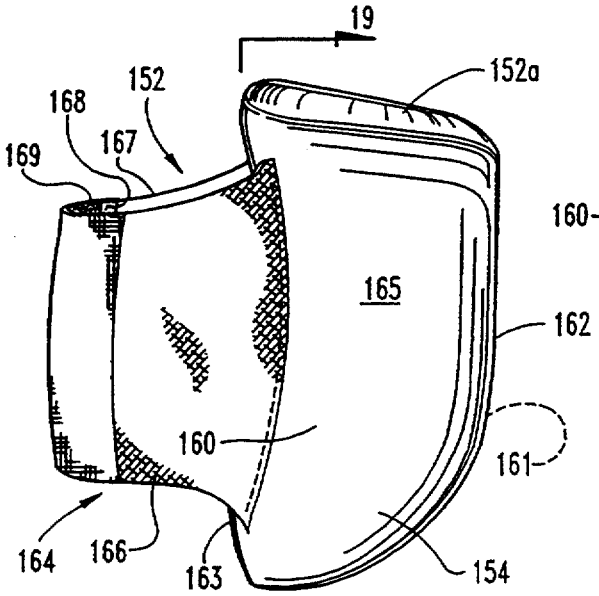
Fig. 17
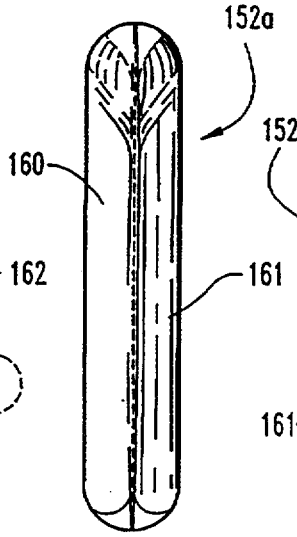
Fig. 18
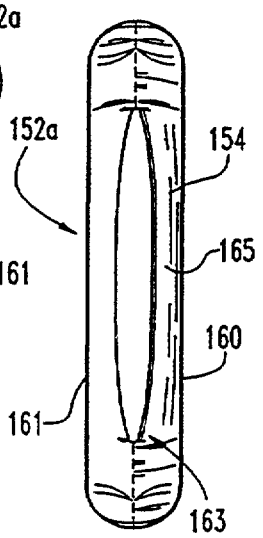
Fig. 19
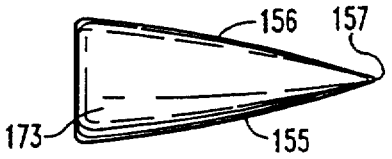
Fig. 23
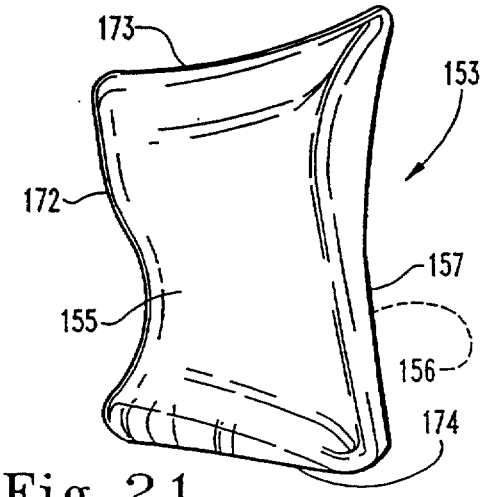
Fig. 21
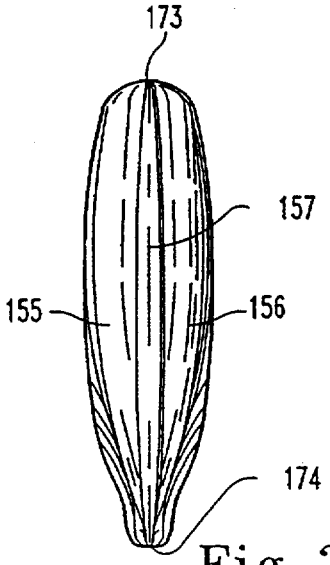
Fig. 22

Fig. 26
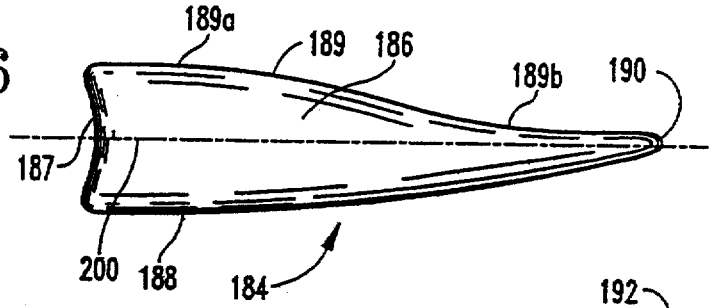
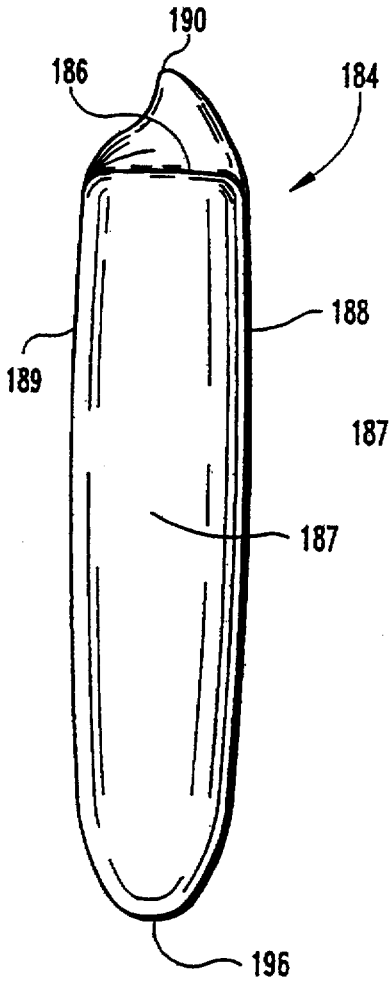
Fig. 25A
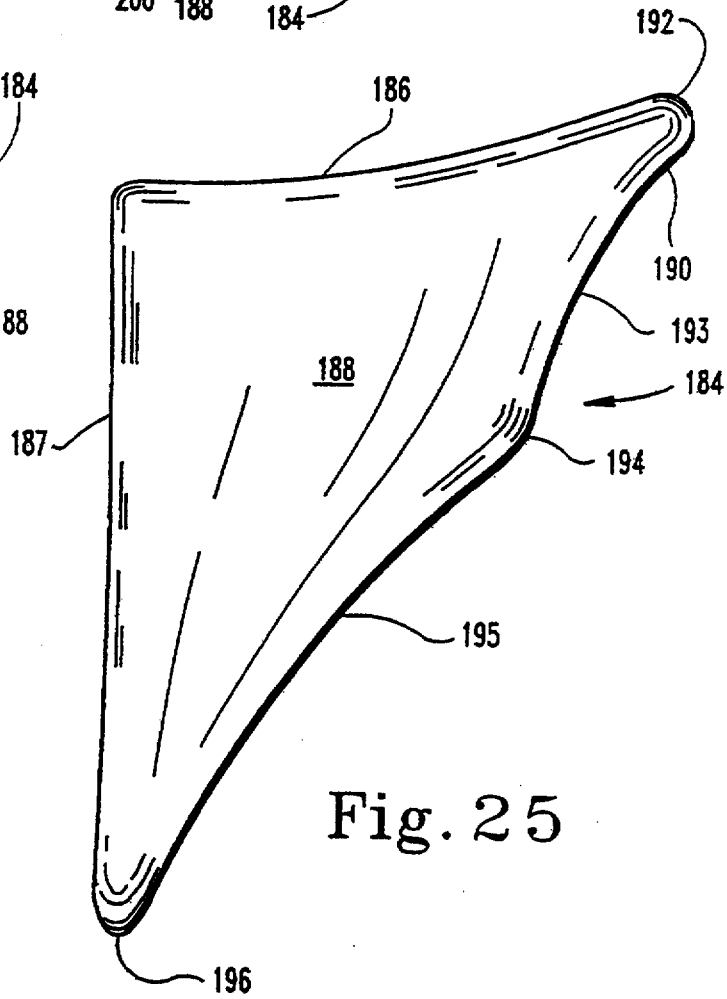
Fig. 25

AERODYNAMIC MODULES FOR CYCLING, SKATING AND OTHER SPEED SPORTS

REFERENCE TO RELATED APPLICATIONS

This patent application is a continuation-in-part application of my prior patent application, Ser. No. 07/851,812, filed Mar. 16, 1992, now abandoned.

BACKGROUND OF THE INVENTION

The present invention relates generally to aerodynamic modules for cycling, skating and other speed sports. Such aerodynamic modules may be used by a cyclist, skater or skier, for example, to improve laminar air flow and reduce wind drag and thereby increase one's speed for the same energy output. More specifically, the present invention relates in one embodiment to a fabric shroud to be worn by a cyclist in order to create a more aerodynamic front contour and improved laminar air flow. In a related embodiment, the cyclist or skier wears an aerodynamic wedge on each arm to reduce wind drag and for the cyclist an aerodynamic pod in the waist-area to improve laminar air flow across the frontal surface of the anatomy. In a still further related embodiment, when a skin suit is worn the aerodynamic wedge for each arm is inserted into an appropriately shaped pouch. In one version, the formed pouch is laminated with an epoxy resin to create a hard hollow shell. A rear spoiler board is disclosed in yet another embodiment for the cyclist to reduce wind drag. In a still further related embodiment the skater uses a combination of an aerodynamic wedge around the calf of each leg and a boot wedge behind the speedskating boot. This embodiment of the present invention is equally applicable to speedskaters using conventional blade skates or the newer roller blade skates. One focus of the present invention as described herein is for use in cycling competitions such as the Tour de France, the Olympics and triathlons. However, as described the various aerodynamic modules will offer significant benefits to other speed sports such as skating and skiing.

Over the years a number of advancements have been made in the design of bicycles for cycling competitions as well as some limited advancements in cyclist clothing. Wheels have been improved by aerodynamic changes in order to reduce wind drag on the spokes. The multi-spoke wheel has given way to the solid or composite wheel. The handlebars have also been improved and shaped and contoured in such a way as to provide a more aerodynamic design and to provide a forearm support surface. The current design of these contoured handlebars enables the cyclist to lean forward and bring the hands together into both a comfortable cycling position and a more aerodynamically compact position. The smaller the projected frontal area of the cyclist which pushes through the wind, the more aerodynamic will be the cyclist and bicycle. This in part is why a cyclist tries to coil his body as much as possible so as to reduce the frontal area which is exposed to the wind. A cyclist will also wear tight fitting clothing to try and reduce as much as possible any loose fabric which would "catch" the wind and increase the drag coefficient of the cyclist. While a focus on reducing the drag coefficient is not of any particular concern for purely casual or social bicycling, it can be critical in competitive cycling situations such as major international races.

Even with the various improvements which have been made over the years, there remains one significant drag component of the cyclist. The front of the cyclist, even when coiled and leaning forward with the head down and the arms resting on the handlebars, still presents a relatively large, concave surface area. If the shape of this front facing surface area could be changed from a concave to a convex configuration, thereby making it more aerodynamically efficient, even though the projected area would remain much the same, the wind drag would be significantly less. One should be able to envision this improvement by considering the aerodynamic benefits of the nose cone shape of an airplane, missile or rocket. The obvious problem though is the inability to reshape the anatomy of the cyclist in order to convert the concave shape to a convex or nose cone profile. In order to achieve the important benefits of a more aerodynamically structured front facing surface without having to alter or distort the normal riding position of the cyclist, the present invention provides in one embodiment a cycling shroud to be worn by the cyclist and which is able to be worn in the normal cycling position. The shroud is shaped and attached to the cyclist so as to form, with the arms extending forward, a forward protruding, nose cone-type shape. This nose cone shape while not actually covering the entirety of the projected surface area of the cyclist's torso, deflects and diverts the oncoming wind around the cyclist rather than onto the cyclist. The nose cone shape improves the laminar air flow across the frontal surface of the cyclist and reduces the slowing or drag force of the on-rushing wind. A substantially lower drag coefficient due to the shape of the shroud results in a faster cycling speed for the same amount or level of expended energy. In related embodiments the cycling shroud is replaced by two aerodynamic wedges which slide over the upper arms of the cyclist, a waist-area tapered pod which presents a protruding nose-cone shape into the on-rushing wind and a rear spoiler board which straps to the cyclist and extends rearwardly to reduce drag. While the inventor is aware of some improvements in bicycles and the use of tight fitting clothing to reduce the drag coefficient, there is no awareness of any type of cycling shroud nor aerodynamic modules similar in any respect to the present invention.

For a speedskater, in addition to the torso, there are other areas of the anatomy which represent aerodynamically inefficient portions, such as the arms and legs. The drag on the arms could be reduced as well as the drag on the legs by the addition of the aerodynamic wedges or wedge shaped forms mentioned for the cyclist. In one embodiment of the present invention provisions are made to attach aerodynamic wedges to the calf and to the rear (heel) of the speedskating boot.

SUMMARY OF THE INVENTION

Aerodynamic modules which are secured to the anatomy of the cyclist, speedskater or skier in order to improve laminar air flow and reduce wind drag according to various embodiments of the present invention include two aerodynamic wedges worn on the arms and/or legs, a waist-area aerodynamic pod which has a forward-protruding, nose-cone shape directed into the on-rushing wind and a rear spoiler board. For a speedskater two aerodynamic wedges are attached to the speedskating boots.

A cycling shroud to be worn by a cyclist in order to reduce wind drag according to another embodiment of the present invention comprises a fabric shroud body defining a pair of arm openings and attachment means joined to the shroud body and designed to secure the shroud body in position across the front of the cyclist.

One object of the present invention is to provide improved speed sport enhancements for improving laminar air flow across the athlete and reducing the wind drag coefficient.

Related objects and advantages of the present invention will be apparent from the following description.

BRIEF DESCRIPTION OF THE DRAWINGS

FIG. 17 is a side elevational view of one aerodynamic wedge of the FIG. 16 combination according to the present invention.

FIG. 18 is a rear elevational view of the FIG. 17 aerodynamic wedge.

FIG. 19 is a front elevational view of the FIG. 17 aerodynamic wedge as viewed along line 19—19 in FIG. 17.

FIG. 20 is a top plan view of the FIG. 17 aerodynamic wedge.

FIG. 21 is a side elevational view of a speedskating boot aerodynamic wedge comprising one part of the two wedge combination of FIG. 16.

FIG. 22 is a rear elevational view of the FIG. 21 aerodynamic wedge.

FIG. 23 is a top plan view of the FIG. 21 aerodynamic wedge.

FIG. 25 is a side elevational view of the wedge-shaped wing which is installed in the skin suit jersey of the FIG. 24 illustration.

FIG. 25A is a front elevational view of the FIG. 25 wedge-shaped wing.

FIG. 26 is a top plan view of the FIG. 25 aerodynamic, wedge-shaped wing installed in the left sleeve of the FIG. 24 cyclist's jersey.

DESCRIPTION OF THE PREFERRED EMBODIMENT

Figure 1:
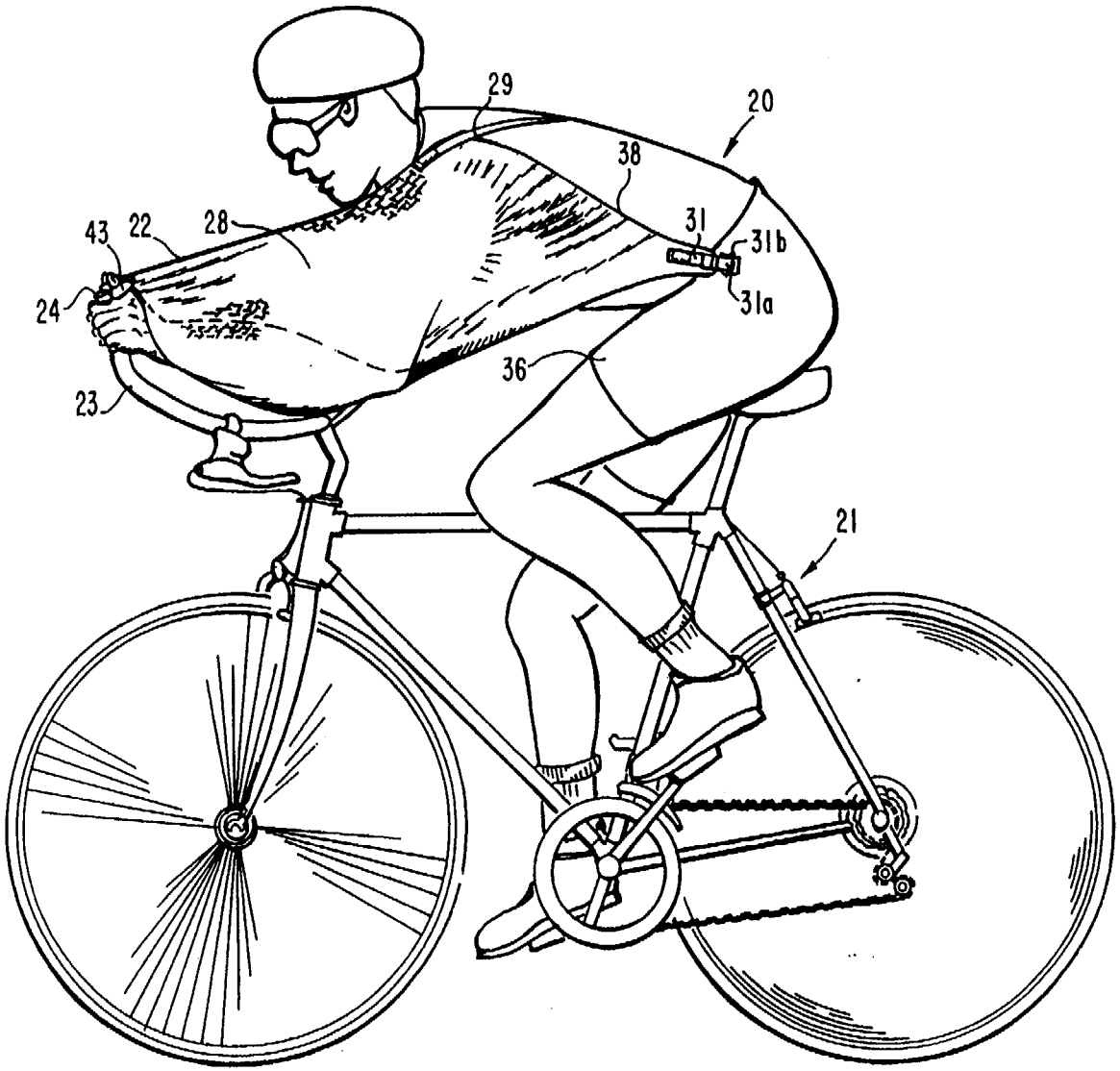
FIG. 1 is a side elevational view of a cyclist wearing a cycling shroud according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
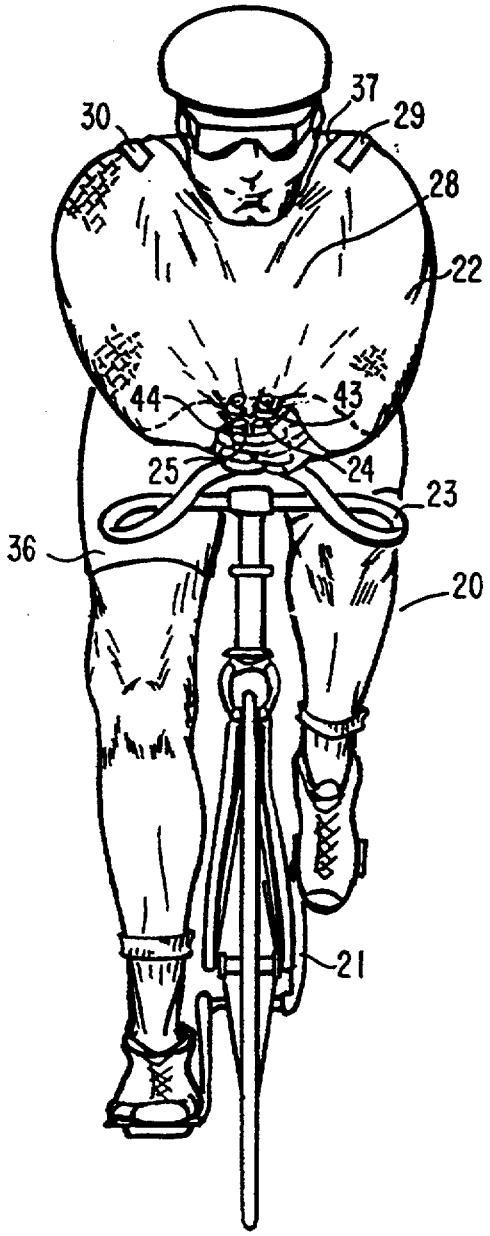
FIG. 2 is a front elevational view of the FIG. 1 cyclist.

Referring to FIGS. 1 and 2 there is illustrated a cyclist 20 riding a competition bicycle 21 and wearing cycling shroud 22 which is designed and worn according to the present invention. The details of bicycle 21 are not particularly important for an understanding of the present invention. The most important feature of the bicycle with regard to an understanding of the present invention is the contoured and forward protruding style of handlebars 23. By means of the handlebars the cyclist is able to lean forward with the head lowered and support the upper body by placing the forearms on the handlebars. This enables the cyclist to cycle in a comfortable position. The forward most ends of the handlebars terminate in generally cylindrical posts 24 and 25 which are closely spaced and extend in an upward direction. These two cylindrical posts are grasped by the hands of the cyclist which brings the hands closer together as the cyclist leans forward with the arms outstretched. As a consequence of the handlebar contour, the spacing of the arms of the cyclist begin at shoulder width and taper to the width of the handlebar posts 24 and 25. This causes a forward tapering of the cyclist's body as the arms are drawn inwardly. The cyclist is positioned on the bicycle and rides the bicycle in a normal fashion. The present invention including cycling shroud 22 does not cause or require any change to the manner of cycling. The only change created by the present invention relates to what the cyclist wears.

Figure 4:
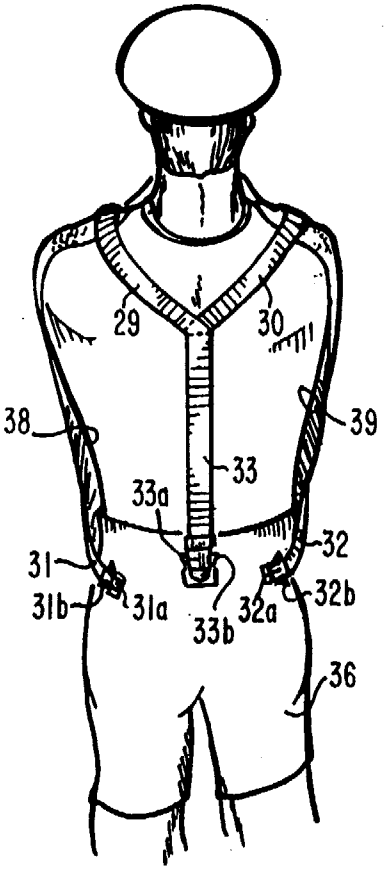
FIG. 4 is a rear elevational view of the FIG. 3 cyclist.
Figure 3:
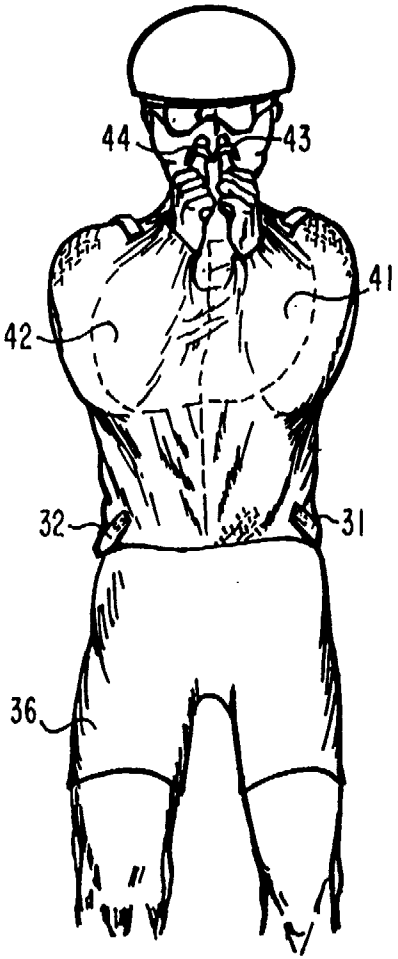
FIG. 3 is a front elevational view of the cyclist standing in an upright position with the arms extended forward.

With continuing reference to FIGS. 1 and 2, cycling shroud 22 includes a one-piece body 28 which is sewn with various seams and darts in order to provide a contoured form and a form which will conform to the anatomy of the cyclist. Attached to the one-piece body 28 are securing straps 29, 30, 31 and 32. There are two shoulder straps 29 and 30 and two hip straps 31 and 32. The two shoulder straps 29 and 30 are oriented into a V-shape and extend into the upper center of the back where they are sewn into center back strap 33. Straps 29, 30, 31 and 32 are sewn directly to the fabric of body 28 and attached at the free end of each strap 31, 32 and 33 is one-half of a clip buckle. Reference to FIGS. 3 and 4 is necessary in order to see all of the straps and to appreciate the manner in which they are oriented and attach both to the body 28 and to the other clothing of the cyclist. The strap-attached half 31*a*, 32*a* and 33*a* of each clip buckle is numbered to correspond to its associated strap.

Referring more specifically to FIGS. 3 and 4, the manner in which straps 31, 32 and 33 attach to the underclothing of the cyclist is illustrated. Although there are possibly other ways to secure the cycling shroud 22 in a proper position on the cyclist, the preferred manner is to fit the underclothing of the cyclist with the mating half of each clip buckle half which is attached to straps 31, 32 and 33. In the FIGS. 3 and 4 illustrations, cyclist 20 is wearing a lower body garment 36 and securely attached to the lower body garment are the three mating halves of the clip buckles. These mating halves of the clip buckles are numbered 31*b*, 32*b* and 33*b* so as to correspond to the numbering of the mating half (31*a*, 32*a* and 33*a*) and to correspond to the numbering of the corresponding strap (31, 32 and 33).

Clip buckle halves 31 and 32 are secured to lower body garment 36 at the sides of the cyclist, somewhat behind and above the hip area. The final clip buckle half 33*b* is secured to the lower body garment of the cyclist at the center of the lower back area as illustrated in FIG. 4.

Clip buckles halves 31*a*, 32*a* and 33*a* constitute the male portion of the clip buckle combination which is pushed into female halves 31*b*, 32*b* and 33*b* and, when fully engaged, lock in position. The clip buckle assembly is separated by pushing inwardly on the sides or inwardly in the middle center (depending on buckle type) of the male portions (31*a*–33*a*) in order to take them out of locking engagement with the female halves 31*b*–33*b*. This type of plastic clip buckle is very similar to what is currently used with nylon dog collars and similar to these collars, the strap which attaches to the male clip half may be adjusted as to length in the well-known manner of adjustable strap and buckle combinations.

The cyclist wears shroud 22 by first placing the shroud over the front of the cyclist and orienting straps 29 and 30 so that they extend from the left shoulder and right shoulder, respectively, of the cyclist to the center back area. In the approximate center of the cyclist's back straps 29 and 30 join to center back strap 33 in a sewn connection. This assembly of straps 29, 30 and 33 draws the neck edge 37 of the shroud snug against the neck of the cyclist. The crossing pattern of straps 29 and 30 joining to strap 33 in the back of the cyclist also pulls the lower side portions 38 and 39 of the shroud snug against the abdominal sides of the cyclist. The single center back strap 33 is attached to the lower body garment 36 by snapping buckle half 33*a* into buckle half 33*b*.

Next the side straps 31 and 32 are pulled downwardly in order to snap buckle halves 31*a* and 32*a* into their mating buckle halves 31*b* and 32*b*, respectively. This assembly step pulls the shroud downwardly from the shoulders to the hips so that the shroud fits snug against the sides of the cyclist for the full length of the shroud from the shoulder area to the hip area. Pulling the sides of the shroud in this manner also draws it tight across the front of the cyclist and around the waist of the cyclist.

As mentioned, the design of the buckles is such that the length of each strap is adjustable in the corresponding receiving male portion. In this manner the fit of the shroud can be adjusted to the size of the cyclist.

The frontal area 40 of the shroud body 28 includes two hand openings 41 and 42. The hands will be inserted through these hand openings prior to clipping all of the straps into position. The hands are thus free to manipulate all of the straps and buckles. Once the shroud is completely fitted to the cyclist and all the buckles are securely clipped into a locked position, the cyclist is ready to begin his ride.

Centered between the two hand openings 41 and 42 are two thumb loops 43 and 44. These two thumb loops are cloth loops sewn directly to the front center of the shroud body. The cyclist places his two thumbs into these loops and leans forward on the bicycle, extending the arms for grasping the two cylindrical posts 24 and 25 of the handlebars 23. This movement of extending the hands forward stretches the frontal area 40 fabric of the shroud body creating a nose cone shape which has a lower drag coefficient than the un-shrouded cyclist. As will be appreciated, the shroud body tapers side-to-side by reducing the forwardly protruding shroud width from a shoulder width to the width of the two handlebar posts. In the side elevational view it can be seen that the shroud extends top to bottom from the shoulder-neck area of the cyclist to the hips of the cyclist. With the cyclist leaning forward and the hands (thumbs in loops) on the handlebar posts, this nose cone shape is achieved while the cyclist remains oriented in the normal and preferred cycling position. The top to bottom position of the hands is between the neck and hips thus creating the forwardly tapered contour. The result is an aerodynamic nose cone contour for the forward facing, projected surface area of the cyclist. This nose cone shape improves the laminar air flow across the frontal surface of the cyclist and reduces wind drag thereby increasing the cyclist's speed for the same energy output or expenditure.

While the shroud fabric may be made from a number of different fabrics and blends, in the preferred embodiment the inventor believes that the best material will be similar to that used by downhill ski racers. This material has a tighter weave and a smoother texture resulting in less drag while at the same time providing the ability to sew straps to the material and the ability of the material to stretch in several directions and to be contoured and shaped so as to fit the cyclist's body. The preferred material is a multiaxial or four-way stretch custom fabric. There are five functional layers in this custom fabric consisting of the following (1) KEVLAR, (2) Lycra, (3) SCHOELLER WB 400, (4) foam and (5) "COOL MAX." The KEVLAR protects against abrasion in case of a crash and the Lycra provides elasticity for a better fit. SCHOELLER WB 400 is a waterproof, wind proof material that still allows the fabric to breath. The foam provides shock absorption in the case of a fall and the COOL MAX layer provides comfort against the skin. This is a swiss-made fabric offered by Schoeller Fabrics.

Figure 5:
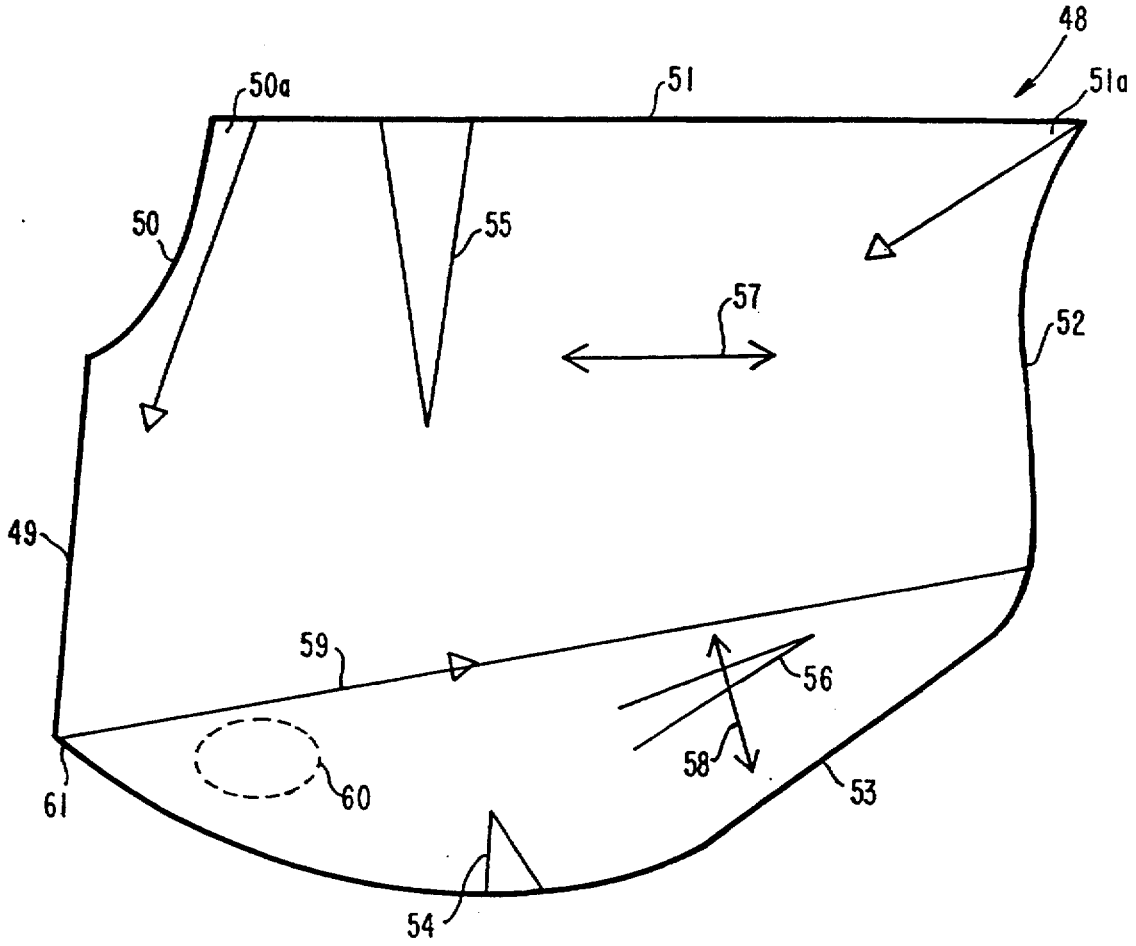
FIG. 5 is a top plan view of a folded one-half panel of the double thickness fabric used to make the cycling shroud of the present invention.

Referring to FIG. 5 the pattern for the fabric of the shroud is illustrated. It is to be understood that while the illustration of FIG. 5 appears to be simply one half panel of the entire shroud, there is a front center fold and thus what is actually illustrated is a double thickness of material. The shroud both begins and ends as a one-piece member, excepting the straps and buckles which are attached.

Fabric panel 48, which as described has a double thickness, has a center front folded edge 49 and the remaining edges illustrated are all unfolded, free edges causing the double thickness, of the fabric to result in a symmetrical cycling shroud. Moving in a clockwise direction, at the upper end of center front edge 49 is the neck edge 50 which has a concave curvature and extends from folded front edge 49 to cut edge 51. The upper corner between neck edge 50 and edge 51 is the shoulder area for the cyclist and it is in the vicinity of this corner 50*a* that the shoulder straps will be attached. Strap 29 will be sewn to one panel of the double thick fabric and shoulder strap 30 will be sewn to the opposite thickness of fabric in virtually the same location as strap 29 for shroud symmetry. Cut edge 51 extends from the shoulder area designated by 50*a* to the hip area designated by 51*a*. This cut edge is substantially straight throughout its length and it is this edge which will actually provide the side edges for the finished shroud, the edges of the shroud which will be disposed against the sides of the cyclist. From edge 51 the shape of the fabric pattern follows a generally convex curvature into cut edge 53. The seam portion of edge 53 begins with the straight portion of cut edge 53, and extends to the lower portion of center front folded edge 49. By understanding that edge 49 is folded and that edge 53 is a seam sewing the two thicknesses together, it can be seen how the finished shroud 22 is sewn and fabricated. As will be understood from the foregoing illustrations and descriptions, the open edges, which remain as free edges in the finished shroud, include neck edge 50, side edge 51 and edge 52 which extends from the hip around the side of the cyclist.

In order to do the appropriate shaping and contouring from the illustrated flat panel 48 into a finished shroud which conforms to the shape of the cyclist anatomy, darts 54, 55 and 56 are illustrated by the corresponding triangular markings on the pattern. Double arrowed lines 57 and 58 indicate the direction of maximum stretch for the fabric and line 59 indicates a line for cutting and adding seam allowance. Finally, broken line 60 indicates the location for the hand openings. As the location of the hand or arm openings (defined by broken line 60) is shifted forward in the direction of corner 61, the actual openings will shift farther down on the arm of the cyclist, such as to the wrists. Likewise as the arm openings in panel 48 shift in the direction of edge 52, the actual openings in the finished shroud will be located closer to the elbow or on up to the shoulder. The cyclist is able to decide where he would like the openings based on how much arm he wants extending from the shroud.

Corner 61 is the place at which the thumb loops are attached and in order to provide some spacing for the loops they are actually sewn inward of the corner but extend forward at that approximate point. Line 59 generally defines the center axial line of the nose cone shape which is created by shroud 22 when properly worn by the cyclist 20 and correctly attached to the cycling tights by the disclosed clip buckles.

Figure 6:
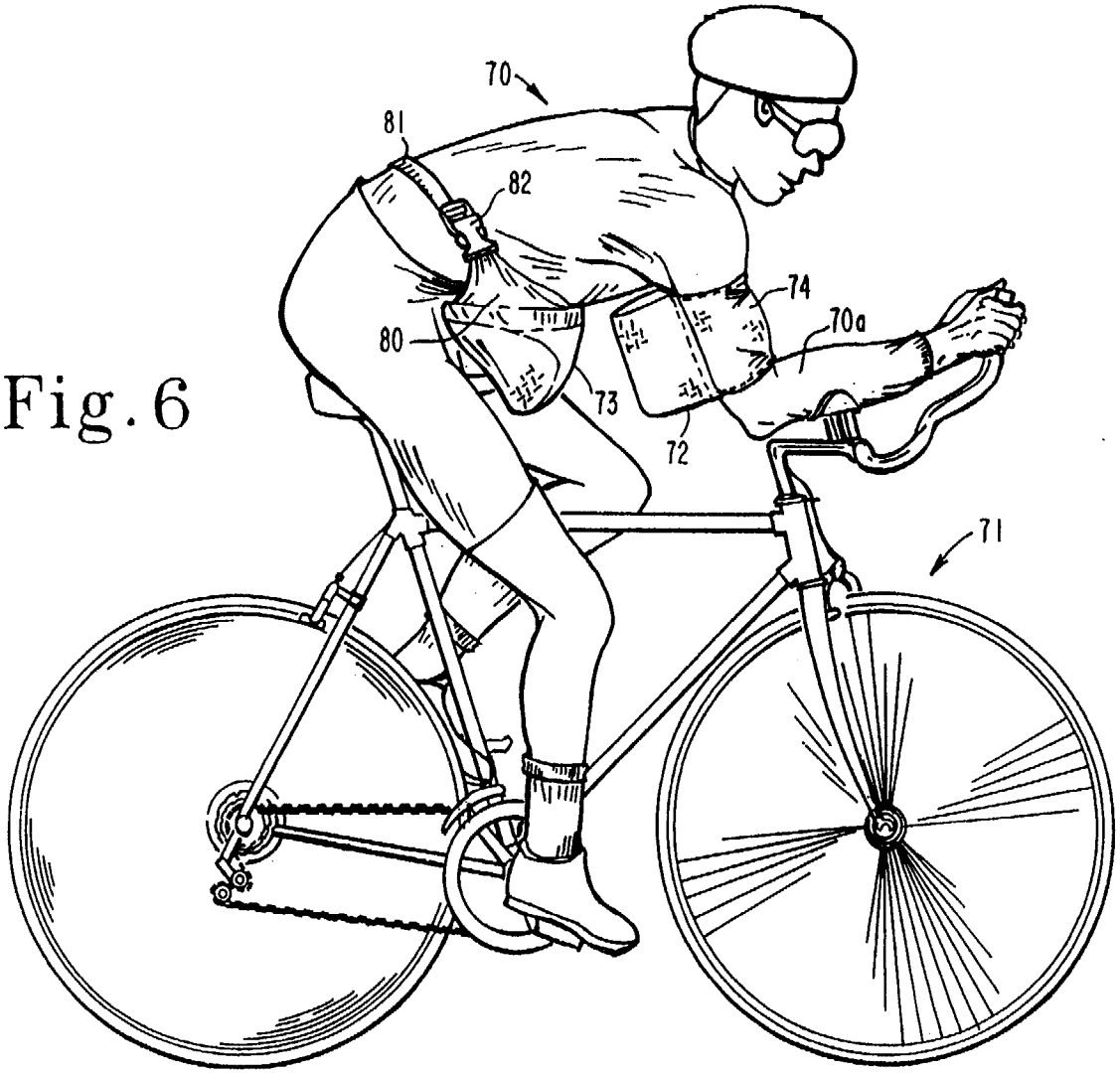
FIG. 6 is side elevational view of a cyclist wearing two arm wedges and one waist pod according to a typical embodiment of the present invention.
Figure 7:
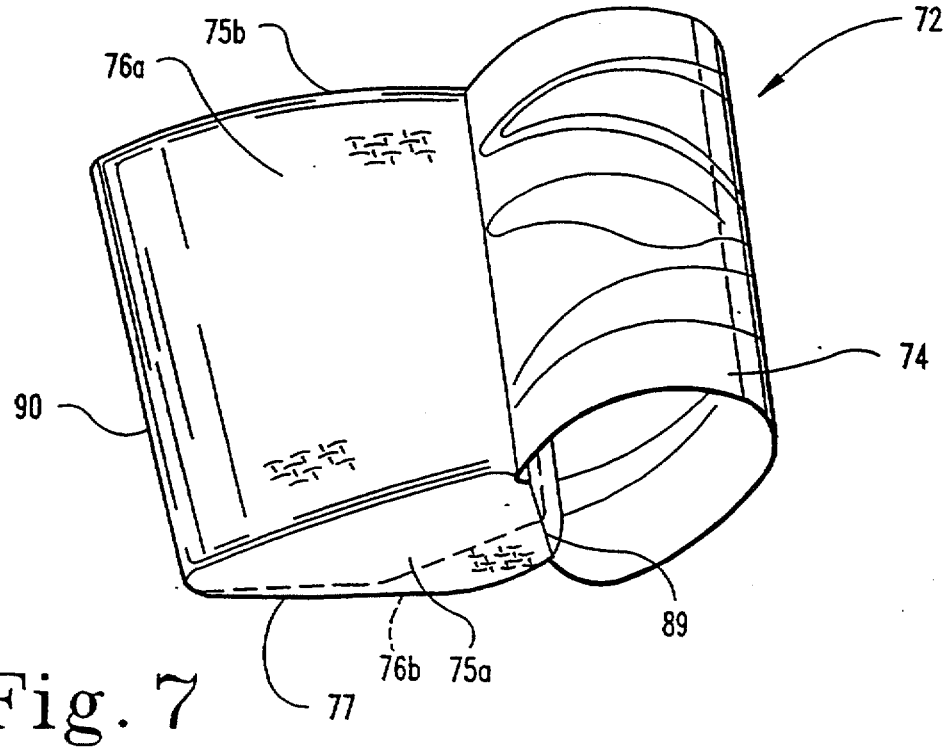
FIG. 7 is a perspective view of one arm wedge according to the present invention.
Figure 8:
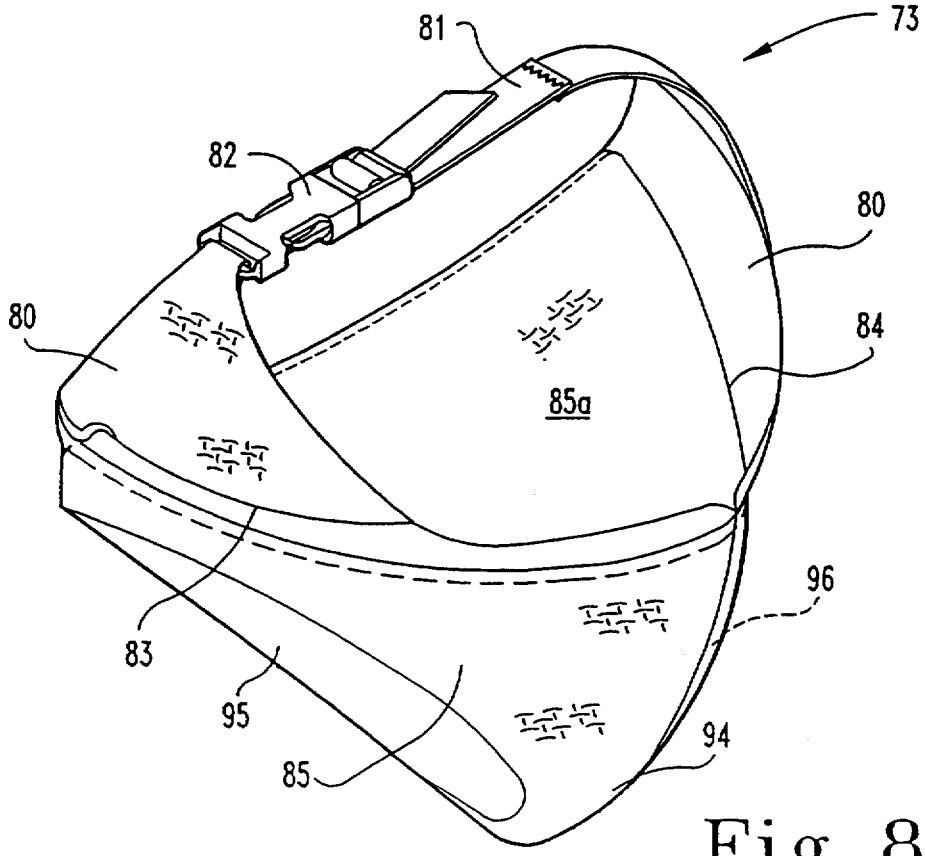
FIG. 8 is a perspective view of a waist-area pod according to the present invention.
Figure 9:
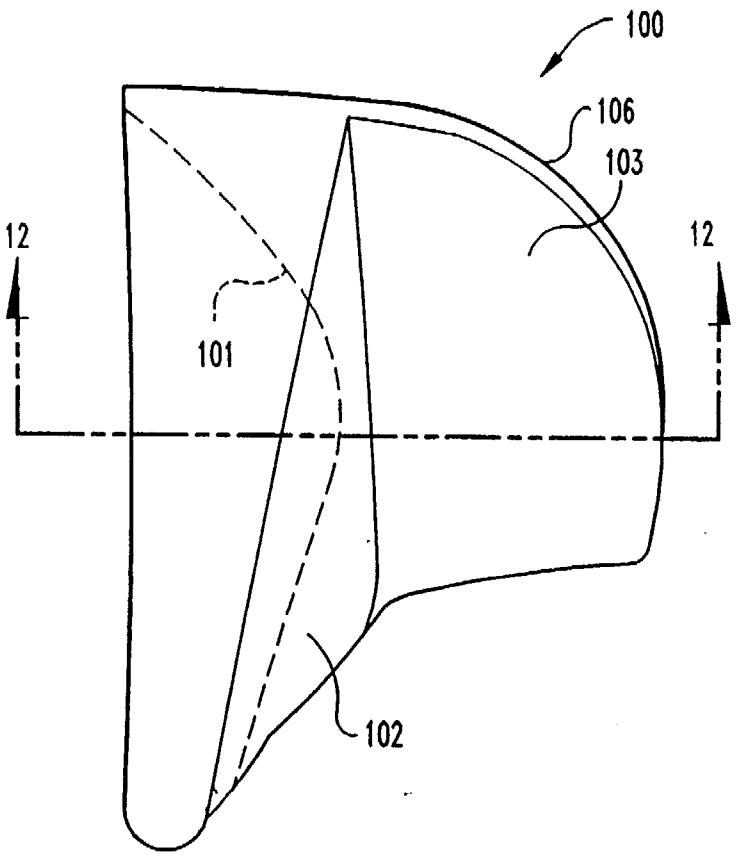
FIG. 9 is a side elevational view of the foam core of the FIG. 8 pod.

Referring to FIGS. 6, 7 and 8 another embodiment of the present invention is illustrated. In FIG. 6 there is illustrated a cyclist 70 riding on a bicycle 71 in a racing posture with the head lowered, arms forward and the back flat. Positioned around each arm 70*a* of the cyclist is an aerodynamic wedge 72 (see FIG. 7) which functions as a wind drag reducer. Although only the right arm wedge 72 is illustrated, positioned on the right arm, the left arm wedge is virtually identical and is similarly positioned on the left arm. The positioning or attachment means for the aerodynamic wedges is a stretch fabric sleeve 74 which is sewn to the sides 76*a* and 76*b* of the wedge body 77. A similar aerodynamic wedge is illustrated in FIGS. 17–20 and is designed to be worn by a speedskater around the calf. While the size and shape of these two aerodynamic wedges may vary slightly as one is for the arm and the other is for the leg, the two are virtually interchangeable and may be worn on either the arms or legs or both. Further concepts and variations for the wedge concept for the arms are illustrated in FIGS. 24–31.

Positioned around the waist is an aerodynamic pod 73 (see FIG. 8) which has a forwardly tapered and protruding contour. This pod improves the laminar air flow across the frontal surface of the cyclist.

The positioning or attachment means for the aerodynamic pod is a combination of a partial stretch fabric sleeve 80 arranged in two portions and strap 81 connecting the two portions. Strap 81 includes a two-part snap-in buckle 82, similar in construction to buckles 31*a*–31*b* and 32*a*–32*b*. The two sleeve portions 80 are sewn to the sides 83 and 84 of the pod body cover 85. By this construction the buckle 82 can be opened, the aerodynamic pod 73 placed over the waist-area of the cyclist, the fabric sleeve portions 80 and strap 81 are wrapped around the waist-area of the cyclist and the buckle halves are snapped back together. The rear surface 85*a* of the aerodynamic pod rests against the waist-area of the cyclist. The rear surface 85*a* is illustrated as being substantially open, the result of cover 85 being trimmed to size so as to draw up just over the edges of the foam core. The peripheral free edges of cover 85 are folded over and sewn into a draw string channel 86. Drawstring 87 is threaded through the channel so that the pod body cover 85 can be removed and cleaned, replaced or repaired. When reassembled the cover is fitted into position and drawstring 87 is pulled tight and knotted. As an alternative construction the cover 85 may be sized to fit completely over the rear surface 85*a* so as to not leave any of the foam interior exposed. The preferred material for cover 85 is a lamination of teflon, polyurethane and a knit of nylon and lycra. A suitable material (fabric) is offered by the LaLame fabric mill located in New York City. A further variation to the foregoing construction of the sleeve portions and strap of pod 73 is to replace the strap with a single stretch fabric sleeve secured to the sides 83 and 84 of the pod body. By the use of VELCRO on one side, the sleeve can be detached and then reattached.

If the means of attachment do not include mating VELCRO strips the aerodynamic pod 73 may be positioned around the waist-area of the cyclist by replacing the VELCRO strips with snaps. Alternatively, both side edges of the fabric sleeve may be sewn directly to the pod body and thereby require the cyclist to slip it on by stepping into the sleeve and pulling the pod up around the waist.

For a snug fit on the arms and around the waist, the fabric for the wedge sleeves and pod sleeve or sleeve portions needs to be a flexible, stretch material whose beginning diameter size is somewhat smaller than the portion of anatomy which it will extend around. This way, with a smaller sleeve which will be tight on a larger cyclist it would still be snug enough on a smaller cyclist to provide a proper fit and allow the wedge or pod to remain in position during cycling.

As illustrated in FIG. 7, each aerodynamic wedge body 77 has a triangular shape in lateral section with generally triangular top and bottom surfaces 75*a* and 75*b*, respectively, and generally rectangular sides 76*a* and 76*b*. The forward face 89 of each wedge fits snugly against the back of the cyclist's upper arm (or alternatively the leg—see FIG. 16) with the tapered edge 90 directed rearwardly. As an alternative to sewing the edge of the stretch fabric sleeve to the sides 76*a* and 76*b* of the wedge body 77, one side can be arranged with mating VELCRO strips. If this technique is employed, then the sleeve can be detached, wrapped around the upper arm and then reattached to secure the wedge body 77 in position.

The contoured shape which results by placing the aerodynamic wedges on the upper arms is a type of airfoil that reduces wind drag by efficiently diverting and directing the flowing air so as to reduce or eliminate the creation of any vortex-like air currents that would increase drag on the cyclist. The more aerodynamic shaping of the cyclist's contour as a result of wearing the arm wedges gives the cyclist an increase in speed for the same energy expenditure. The same is true for the speedskater of FIG. 16 and use of aerodynamic wedges on the calf and boot. A similar, though more shaped or contoured wedge-shaped wing is illustrated in FIGS. 24–31.

The construction of wedges 72 and pod 73 includes a high density, synthetic foam interior covered by a tight fitting, stitched fabric, such as the lamination material offered by the LaLame mill. The foam interior may be solid or hollow. The relative sizes and materials are variables, but it is helpful to have the arm wedges extend from the area of the elbow to the area of the shoulder as this is the upper arm area which is directed into the wind. As will be appreciated in FIG. 6, the forearm areas of the cyclist are pointed horizontally into the wind and thus these portions of the anatomy do not present the same wind drag inefficiency as does the upper arm.

Another area of the cyclist's body which traps or catches the onrushing wind is the area above the thighs, below the chest and around the waist. In the cycling position of FIG. 6 the concave shape of the cyclist's anatomy can be appreciated. It is in the waist-area that aerodynamic pod 73 is positioned. The pod has a tapered, contoured nose cone shape with a forward protruding edge 94 and covered side pockets 95 and 96. This tapered and contoured shape is effective to deflect and divert the onrushing wind around the sides of the cyclist, thereby improving the laminar air flow across the frontal surface or the cyclist. By use of the aerodynamic pod, the onrushing wind does not catch the concave shape of the cyclist's anatomy and results in an increase in cycling speed for the same energy expenditure.

With regard to the pod, it should be large enough to cover the waist-crotch area and protrude forward far enough to project into the onrushing wind. The size of the waist-area pod is important so that it catches the onrushing wind early enough and can thereby divert it from the sides of the cyclist. The ultimate objective in sizing and positioning of the waist-area pod is to reduce any significant drag against the concavity of the cyclist's body.

Referring to FIGS. 9–12 the interior foam body 100 of pod 73 is illustrated without cover 85 attached. This interior foam body 100 has a scooped out rear surface 101, base panel portion 102 and tapered keel 103. The surface contouring and geometry of the interior foam body 100 as well as the relative size proportions are illustrated by FIGS. 9–12. As can be appreciated, the keel 103 has tapered sides 104 and 105 as well as a tapered, forward protruding edge 106. Edge 106 of body 100 corresponds to edge 94 of the covered pod 73.

Figure 10:
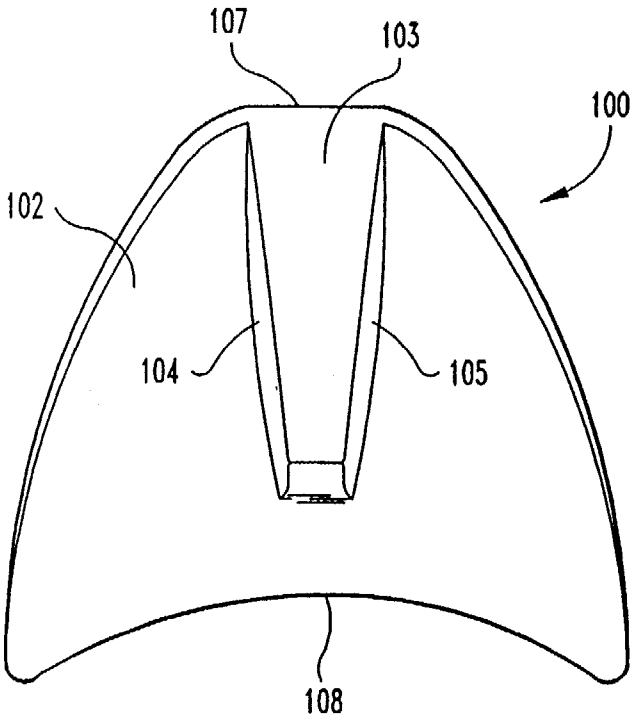
FIG. 10 is a front elevational view of the foam core of the FIG. 8 pod.
Figure 11:
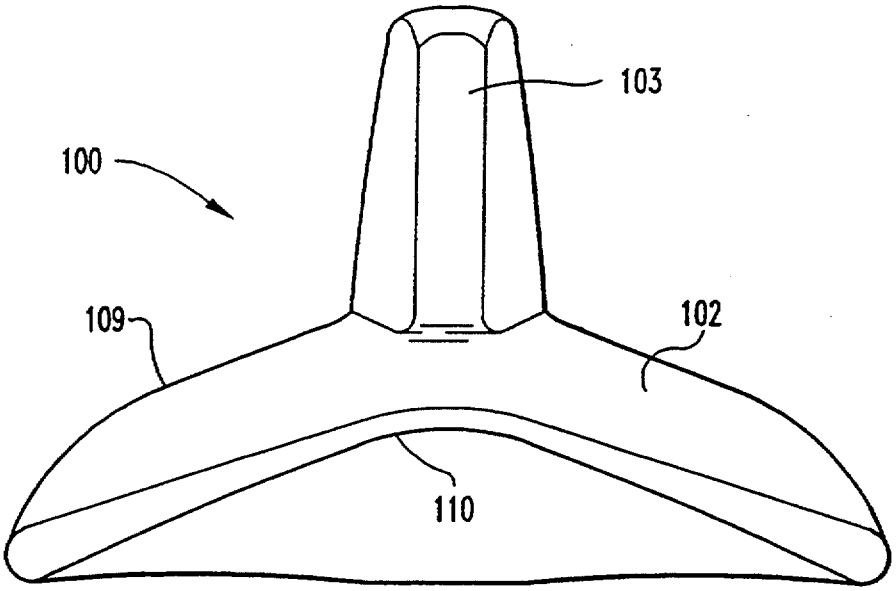
FIG. 11 is a bottom plan view of the foam core of the FIG. 8 pod.

As will be appreciated from FIGS. 10 and 11, the keel is centrally disposed relative to base panel portion 102 and extends from top edge 107 to a location spaced apart and upwardly from lower edge 108. Portion 102 has a convex top surface 109 and a concave lower surface 110.

Figure 12:
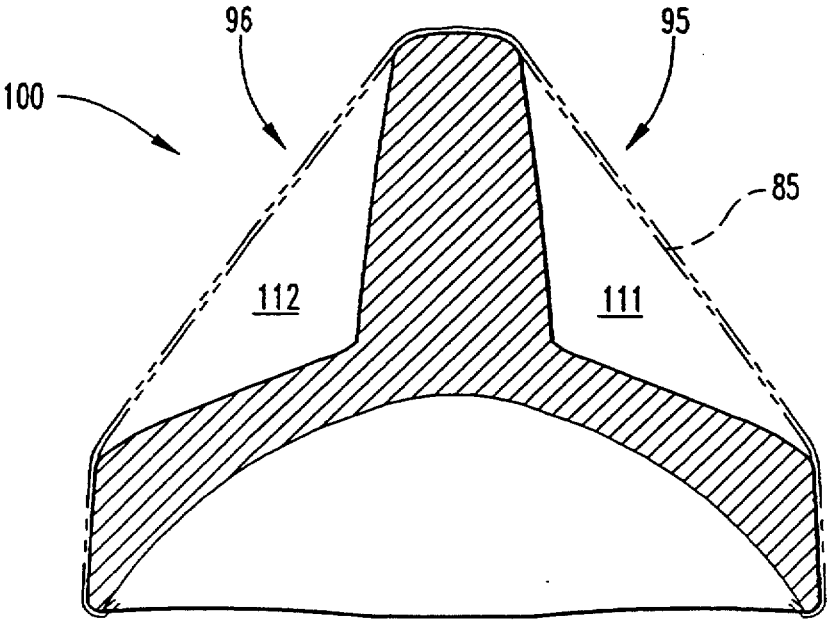
FIG. 12 is a bottom plan view of the foam core of the FIG. 8 pod in full section as taken along line 12—12 in FIG. 9.

The open areas 111 and 112 defined by the sides of the keel 103 and the top surface of 109 of portion 102, once covered by cover 85, create the enclosed side pockets 95 and 96 (see FIG. 12). These side pockets provide the desired aerodynamic contour to the pod while creating clearance spaces for the legs of the cyclist. In the illustration of FIG. 6 which shows the placement of the pod on the cyclist, it should be appreciated that as the legs of the cyclist rise during the pedaling stroke, the thighs will be pushed up against the sides of the pod. As the portions of the cover 85 which are disposed over open areas 111 and 112 yield, there is clearance provided beneath the cover for the cyclist's thighs. As the thighs are lowered, the cover returns to the nose cone shape for maintaining the aerodynamic contour.

Figure 13:
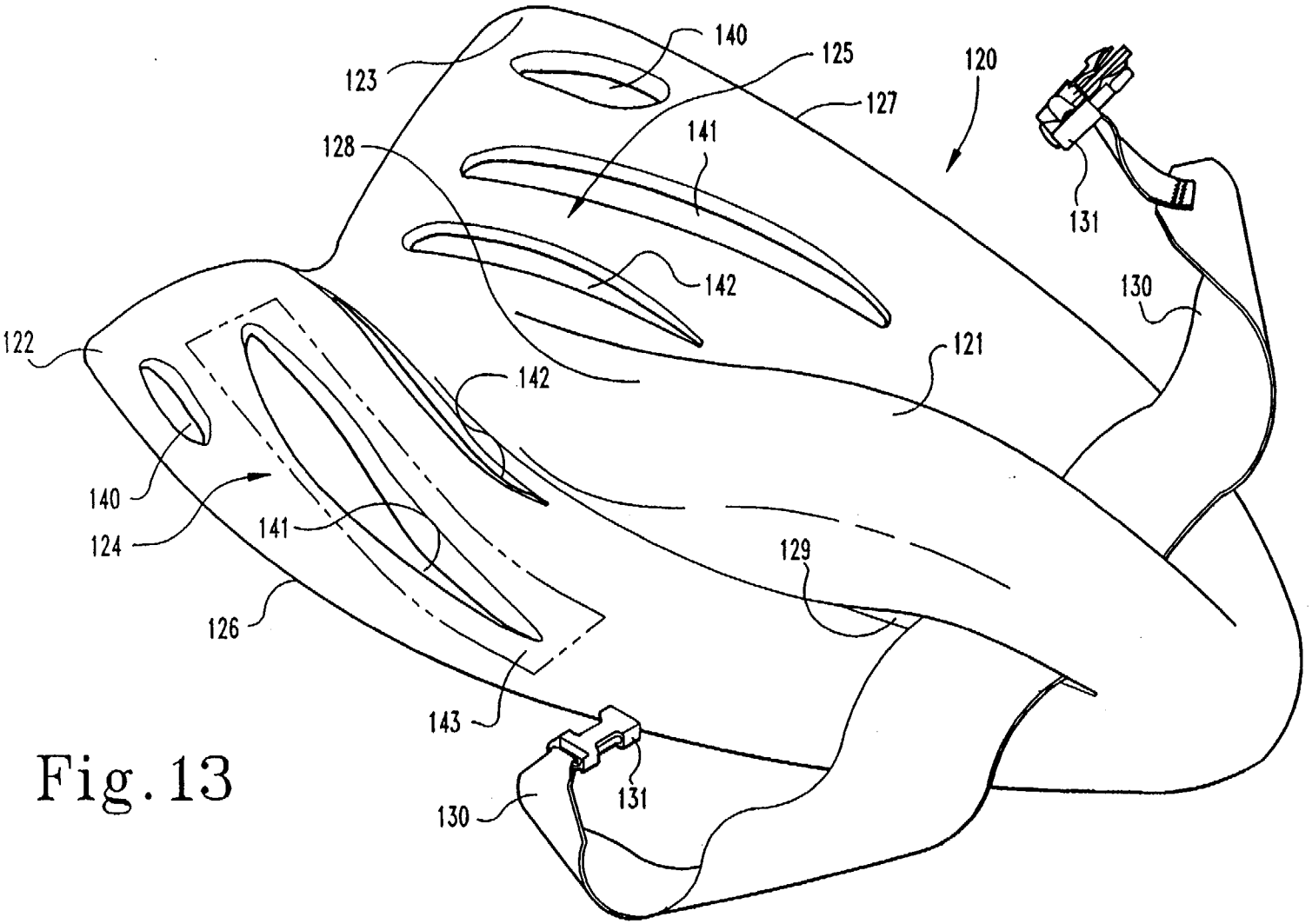
FIG. 13 is a perspective view of a rear spoiler board according to a typical embodiment of the present invention.
Figure 14:
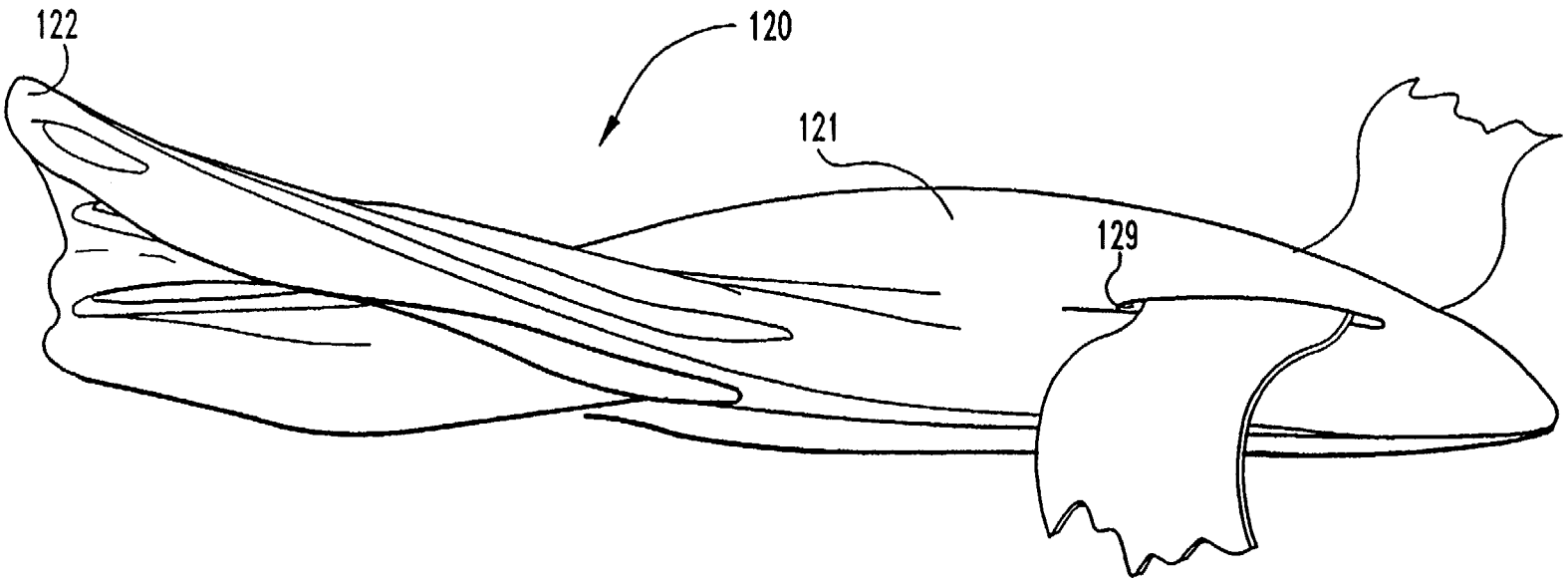
FIG. 14 is a side elevational view of the FIG. 13 rear spoiler board.

Referring to FIGS. 13 and 14 there is illustrated a rear spoiler board 120 which is contoured with a raised center rib 121 and oppositely disposed side wings 122 and 123. Lower concave regions 124 and 125 are positioned between side edges 126 and 127 and the rearward portion 128 of the center rib. The forward portion of rib 121 includes a securement strap slot 129 for receipt of strap 130. Two piece buckle 131 completes the assembly in order to enable the board 120 to be strapped around the waist of the cyclist and secured in that position.

Figure 15:
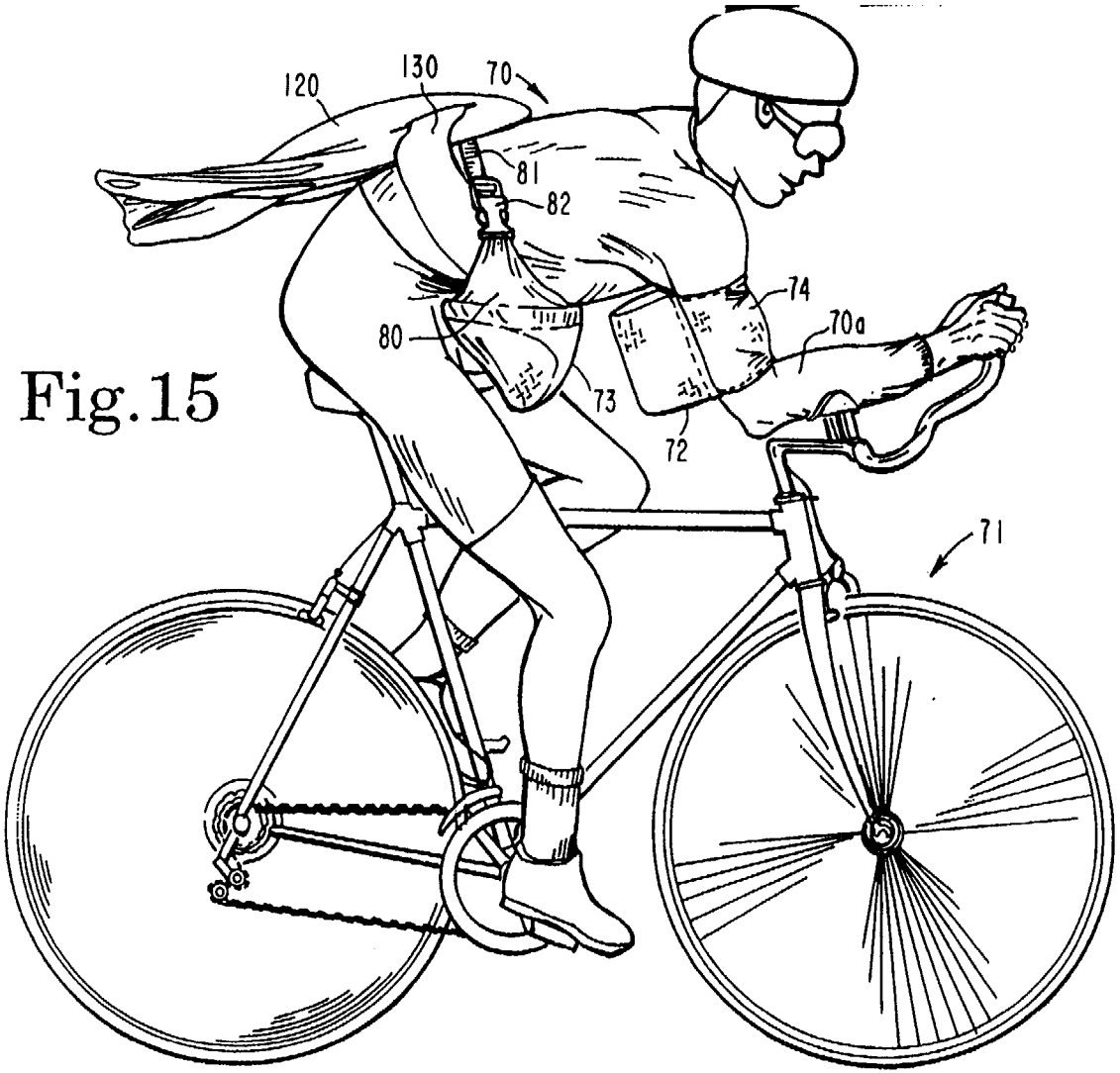
FIG. 15 is a side elevational view of the FIG. 6 cyclist wearing the FIG. 13 rear spoiler board.

Board 120 is formed out of synthetic foam material and has a rigidity of form while still being light in weight. Referring to FIG. 15, the position and orientation of the rear spoiler board 120 on the cyclist is illustrated. As shown, strap 130 extends around the waist of cyclist 70 and the attachment is completed by snapping the two halves of buckle 131 together.

As has been described, the nose cone shaped pod 73 improves the laminar air flow across the frontal surface of the cyclist. However, in order to reduce the drag on the cyclist it is desirable to maintain the flow of on-rushing wind off of and away from the cyclist. Without the use of board 120 as oriented on the cyclist, the flowing air across the frontal surface of the cyclist can actually result in or create a vortex flow action and the result of this is a suction-type of drag on the cyclist. Rear spoiler board 120 reduces such drag and is a compliment to arm wedges 72 and aerodynamic pod 73.

Since the specifics of a cyclist's anatomy will have some bearing on what size of pod 73 is preferred, the pod is offered in various sizes, such as small, medium, large and extra large. The rear spoiler board may also be offered in different sizes, but there is a modification which the cyclist can make in order to fine tune his own rear spoiler board. As illustrated in FIG. 13, regions 124 and 125 are each provided with a series of open slots 140, 141, and 142. While the three slots on one side of the center rib are initially identical in size and shape and location to the three slots on the other side of the rib, these three slots, six total, can in fact have virtually any size and shape and can be selectively modified to suit the particular cyclist.

Since the rear spoiler board is made of a synthetic material, the specific shape and contouring of the open slots 140–142 can be modified to suit the aerodynamic characteristics of each cyclist. The slots can be reshaped, enlarged or even closed, such as by the use of an overlaying layer of tape or by plastic stick-on covers 142 which are illustrated in broken line form. If wind tunnel testing is employed, the preferred or optimum board size, slot arrangement and slot shape for a specific cyclist can be determined.

Figure 16:
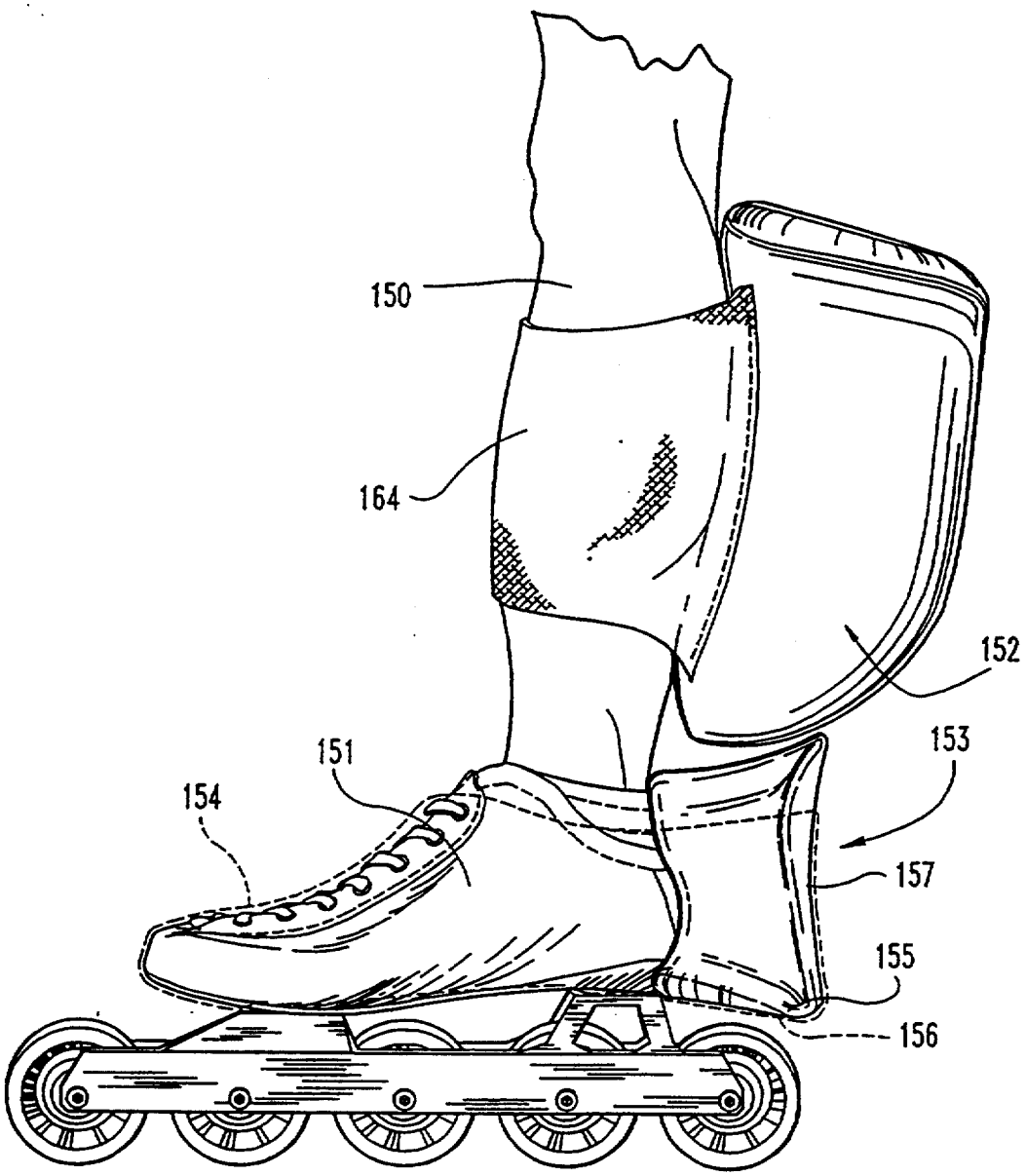
FIG. 16 is a side elevational view of a speedskater's leg and foot with aerodynamic wedges attached according to a typical embodiment of the present invention.

Referring to FIG. 16 there is illustrated the lower leg 150 of a speedskater on which a roller blade boot 151 is worn and to which a pair of aerodynamic wedges 152 and 153 are attached. Wedge 152 is worn around the lower portion of the calf of the speedskater in a manner very similar to how the arm wedges are worn by the cyclist in FIG. 6. Wedge 153 has a slightly different size and shape compared to wedge 152 and is actually positioned within a stretched boot cover 154 which is illustrated by the brokenline. The boot wedge 153 has a shape that conforms to the heel portion of boot 151 and tapers rearwardly such that the sides 155 and 156 converge and define a rear edge 157. Since the roller blade boot has no particular significance, the entirety of the disclosed embodiment of FIG. 16 could be used on conventional bladed skates without any changes or alterations.

Referring to FIG. 17–20 aerodynamic wedge 152 is illustrated in greater detail. Wedge body **152*a* includes tapering sides 160 and 161 which symmetrically converge into rear edge 162. As illustrated in FIG. 20, wedge body 152*a* has a generally triangular lateral cross section and a front face 163 which is the widest point and which abuts up against the lower calf area. Stretch fabric sleeve 164 is sewn directly to vinyl covering 165. The sleeve 164 consists of two panels 166 and 167 one each being sewn adjacent front face 163 along each side. The free ends of each panel 166 and 167 include a mating strip of "VELCRO" material, such that the strip 168 of hook-like projections is on panel 167 and the strip 169 of loop-like projections is on panel 166. Wedge body 152*a* is hollow and formed out of a suitable plastic material or alternatively formed out of fiberglass. The vinyl covering 165 is tightly stretched over the hollow plastic form and partially closes in open front face 163 (see FIG. 19). The rear elevational view (FIG. 18), front elevational view (FIG. 19) and top plan view (FIG. 20) are limited to the wedge body 152*a* and do not include fabric sleeve 164**.

Referring to FIGS. 21–23 aerodynamic wedge 153 is illustrated in greater detail. Wedge 153 includes converging sides 155 and 156 which join together at rear edge 157. Wedge 153, which is positioned adjacent the heel of the boot 155 within cover 154, has a generally triangular lateral cross section as indicated by the top plan view of FIG. 23. The material for wedge 153 may be the same as that used for wedge 152 or alternatively the material may be one of the rigid foams. Front face 172 is the widest portion of wedge 153 as to its side-to-side thickness and is slightly concave in order to match the boot heel contour. The top surface 173 of wedge 153 has a slight compound curvature and the lower edge 174 is formed by the converging of sides 155 and 156.

The important material properties for wedge 153 include lightweight and shapeability. Weight is a concern because a heavy wedge will accelerate leg or arm fatigue. Shapeability is important because the wedge can be styled to the precise size and shape desired for the particular sport and athlete. The exterior of wedge 153 is painted in order to provide a smoother surface and a more aerodynamically efficient surface over that of exposed, porous foam. An alternative to painting is to use a smooth covering in order to make the wedge more aerodynamically efficient.

Figure 24:
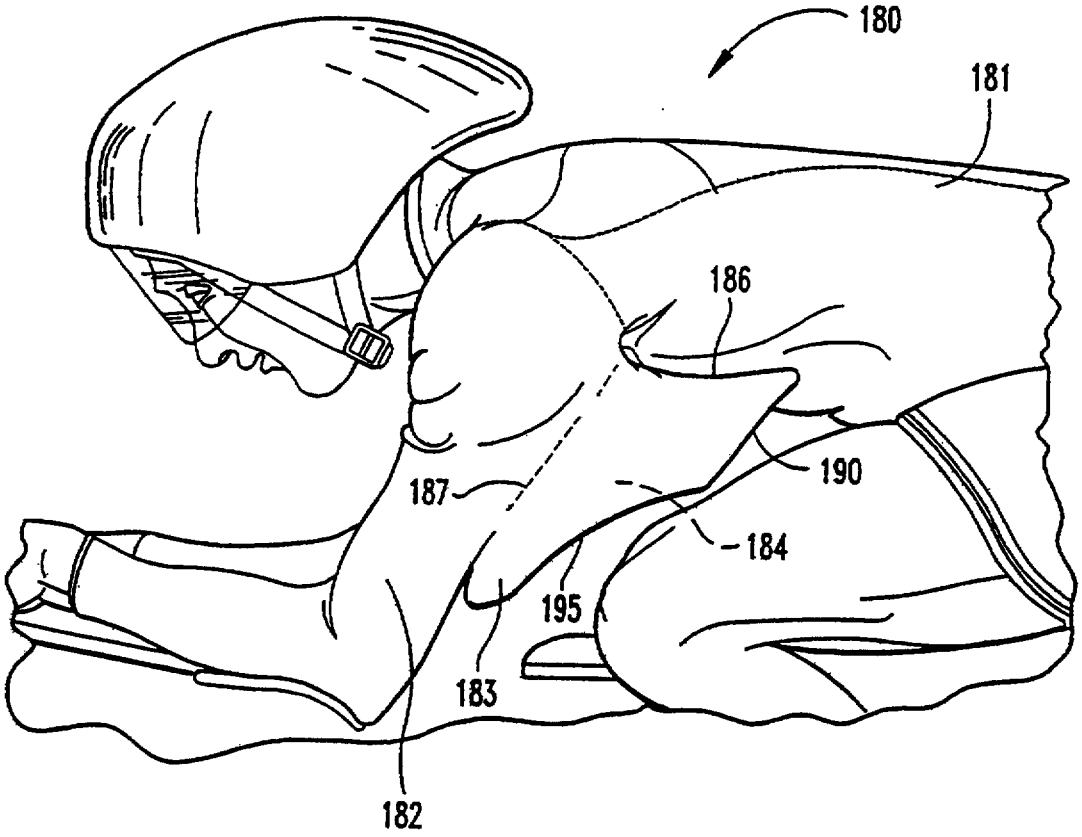
FIG. 24 is a partial, side elevational view of a cyclist wearing a skin suit into which aerodynamic, wedge-shaped wings in accordance with the present invention are installed.

Referring to FIG. 24 there is illustrated a cyclist 180 wearing a tight-fitting skin suit jersey 181 which is used for greater aerodynamic efficiency. This skin suit jersey is generally conventional in most respects including the material and the particular fit for the cyclist. As to the general construction and configuration of jersey 181 there is one important change and this change is the creation of a pouch-like modification to the rearward area of each sleeve 182 in the area of the upper arm. The fabric pouch 183 illustrated for the left arm is similar to the fabric pouch of the opposite side (right arm) which is not illustrated. As will be described hereinafter, the wedge-shaped wings which are installed in each fabric pouch are not symmetrical about their front to rear centerline and thus these wings as well as the corresponding fabric pouches have a left side and right side configuration and while virtually identical, they are turned relative to each other to accommodate the left side/right side differences.

Figure 27:
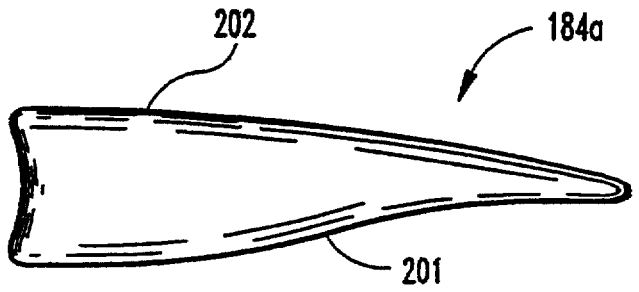
FIG. 27 is a top plan view of the right side aerodynamic, wedge-shaped wing which is installed in the right sleeve of the FIG. 24 cyclist's jersey.

Inserted into fabric pouch 183 from the inside of sleeve 182 is a generally wedge-shaped aerodynamic foam wing 184 (see FIGS. 25, 25A, and 26). The right arm fabric pouch which is not illustrated receives a similarly shaped foam wing **184*a* see FIG. 27). Since foam wings 184 and 184*a* are not symmetrical about their front to rear centerlines, they are styled, as mentioned, as left wing 184 and a right wing 184*a*. The left to right differences can be appreciated by a comparison of the FIGS. 26 and 27 illustrations. With regard to the size, shape and function of pouch 183 and wings 184** and 184*a*, there are a few basic relationships which are important to preserve. Although reference will be made to the left arm of the cyclist, pouch 183 and wing 184, most of the description is equally applicable to the right arm and wing 184*a*.

First, the opening between the fabric pouch 183 and the interior of sleeve 182 needs to be of sufficient size for foam wing 184 to be inserted. Secondly, the specific three dimensional shape of pouch 183 should closely approximate the three dimensional shape of wing 184 so that the fit of the pouch is smooth and tight around the wing on all surfaces and in all areas. Since the material used for jersey 181 is typically a stretch fabric, the pouch may be slightly undersized and a little off dimensionally without any significant adverse effects as this fabric will stretch and conform around the aerodynamic wing in order to provide the desired smooth and tight fit.

The smooth and tight fit mentioned is important so that there are no areas of loose fabric which might catch the onrushing wind and create additional drag or increase any drag already attributed to this surface. The cyclist wants to be aerodynamically efficient as possible and this is why all the attention to streamlined helmets, frames, handlebars and skin suits.

Referring to FIGS. 25, 25A, and 26, wedge-shaped aerodynamic foam wing 184 is illustrated and includes a top surface 186, a front surface 187, and oppositely disposed side surfaces 188 and 189 which converge to a common rear edge 190. The top surface 186 is slightly curved (concave) from front surface 187 to rear edge 190 and is substantially flat to slightly convex from side-to-side. The side elevational, projected outline shape of wing 184 is best illustrated in FIGS. 24 and 25 whereat concave upper surface 186 extends to tip 192 at which point rear edge 190 begins. This rear edge includes an upper portion 193 which is substantially straight to slightly concave from tip 192 to tip 194 and a lower portion 195 which is concave from tip 194 to lower surface 196. As illustrated, sides 188 and 189 converge to the common rear edge 190 along both upper and lower portions 193 and 195, respectively.

The concave lower portion 195 is cut in enough so as to provide more knee clearance for the cyclist. In this area the two side surfaces are generally convex in shape. Front surface 187 has a generally rectangular shape which tapers very sightly from top to bottom. The front surface is slightly curved (concave) side to side so that it will more comfortably fit up against the rearwardly (back) facing surface of the cyclist's upper arm. Additionally, the side-to-side distance across surface 187 from side 188 to side 189 is less than the diameter of the cyclist's upper arm in the area where the wings are positioned. This sizing and positioning is important for the front, outer edges of each wing to be inset behind the corresponding arm of the cyclist. This helps the overall aerodynamic efficiency of the wings when applied to the cyclist. In the preferred embodiment the side-to-side distance across front surface 187 is roughly 90% of the diameter of the upper arm.

Referring to FIGS. 26 and 27 the curvature of the upper areas of the two side surfaces of each aerodynamic wing are illustrated. Referring first to the left arm wing 184, it includes two side surfaces 188 and 189 which are contoured in such a way that the outer most side surface 188 is smoothly shaped with a continuous convex curvature from front surface 187 to common rear edge 190. This convex curvature extends from top to bottom. Inside surface 189 has a compound curvature in its upper area beginning at front surface 187 and extending rearwardly with a convex portion 189*a* which transitions into concave portion 189*b* and this portion extends to rear edge 190. This compound curvature exists for approximately the top or upper 60 percent of the wing, roughly to the level slightly below tip 194. Below this level (the lower 40 percent) the concave part disappears and side surface 189 is convex throughout. Centerline 200 bisects front surface 187 between side surfaces 188 and 189 and intersects common rear edge 190.

The distance from front surface 187 to rear edge 190 along side surface 189 in the upper 60 percent of the wing is greater than the distance from front to rear along side surface 188. This causes the onrushing wind (air) passing across wing 184 to move faster across side surface 189 than across side surface 188. Side surface 189 faces the interior area of the cyclist in the area of the abdomen and crotch. The result of this faster air flow across side surface 189 is to reduce turbulence in the crotch area of the cyclist, making the cyclist more aerodynamically efficient.

Referring to FIG. 27, the right side wing 184*a* is illustrated. With the exception of reversing the two opposite side surfaces 201 and 202 relative to side surfaces 188 and 189, wing 184*a* is identical to wing 184. Surface 201 corresponds in all respects to surface 189 and surface 202 corresponds in all respects to surface 188. Surfaces 201 and 189 are both inwardly facing toward the abdomen and crotch area of the cyclist and each includes the compound curvature in the upper area resulting in faster air flow. All other aspects of the right-side wing 184*a* are identical to those corresponding aspects of left-side wing 184.

Figure 28:
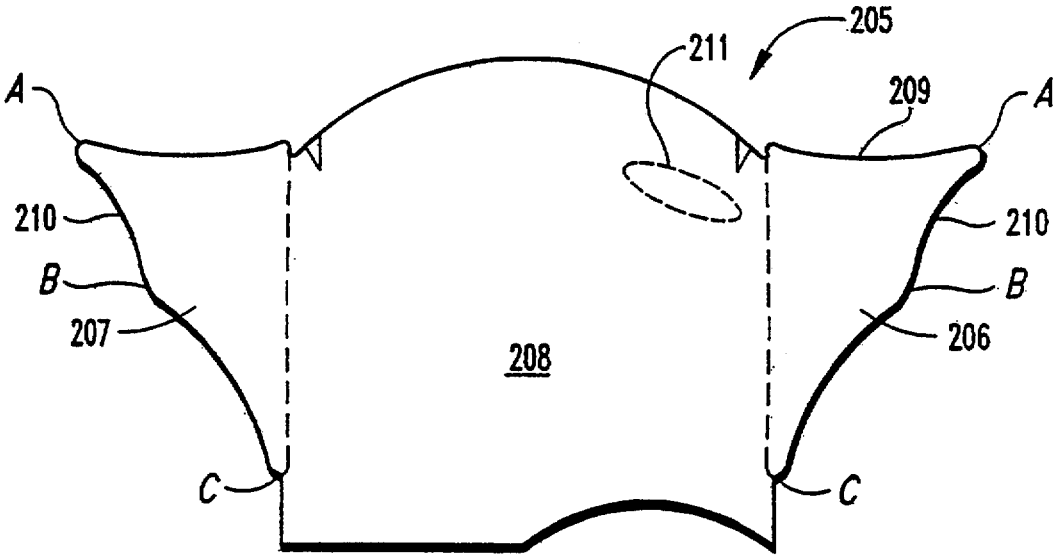
FIG. 28 is a top plan view of the fabric panel which is sewn together in order to create the left sleeve of the FIG. 24 cyclist's jersey including the pouch which is created for receipt of the aerodynamic wing.

Referring to FIG. 28 the fabric panel 205 used to construct the upper arm portion of the left sleeve 182 for wing 184 is illustrated. Outer panels 206 and 207 are integral with sleeve panel 208 and are shaped so as to create pouch 183 for the receipt of wing 184. The outer panels 206 and 207 are drawn together and carefully aligned to match up points A, B and C. Once properly aligned, the two outer panels are sewn together along lines 209 and 210. Outline 211 represents a dart cut out.

While the preferred embodiment for creating a pouch in the jersey sleeve in order to receive a removeable, replaceable aerodynamic wing has been described and illustrated, there are a number of variations contemplated within the scope and teachings of the present invention.

Figure 29:
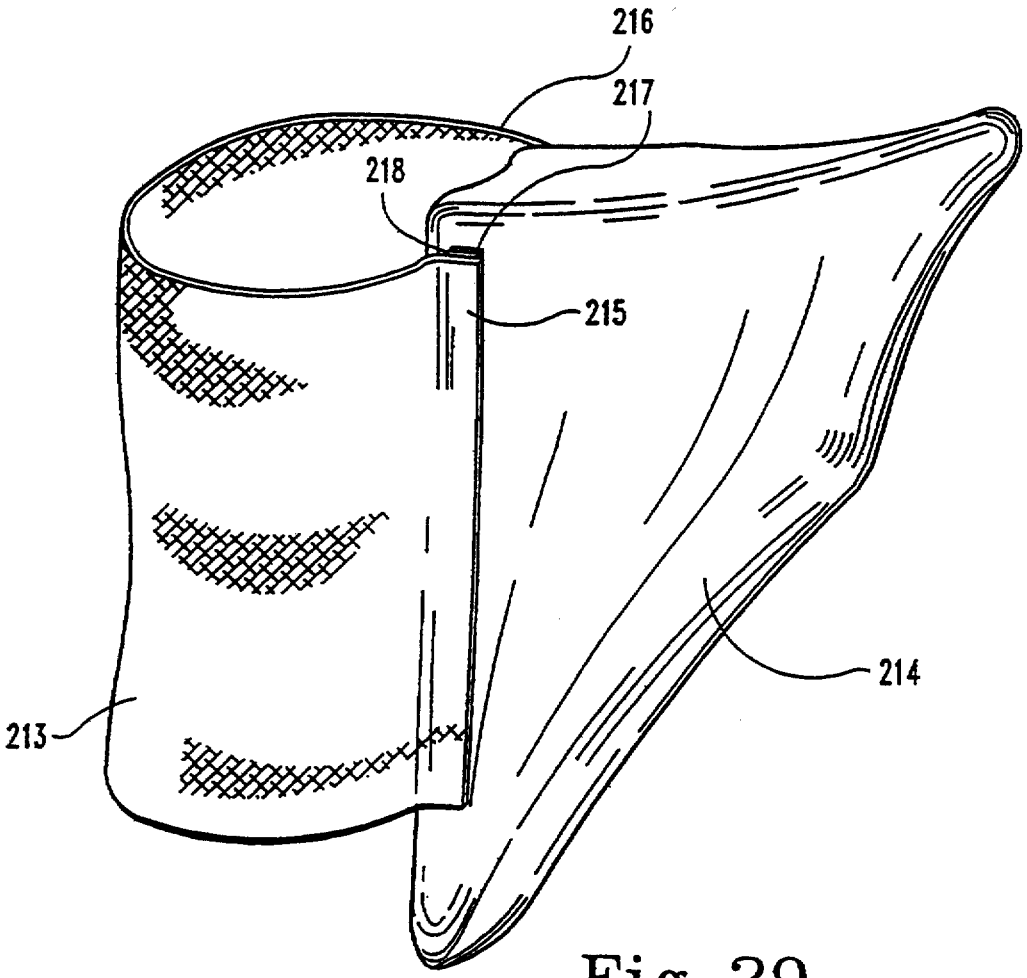
FIG. 29 is a side elevational view of the FIG. 25 aerodynamic wing with an alternative attachment arrangement according to the present invention.
Figure 29A:
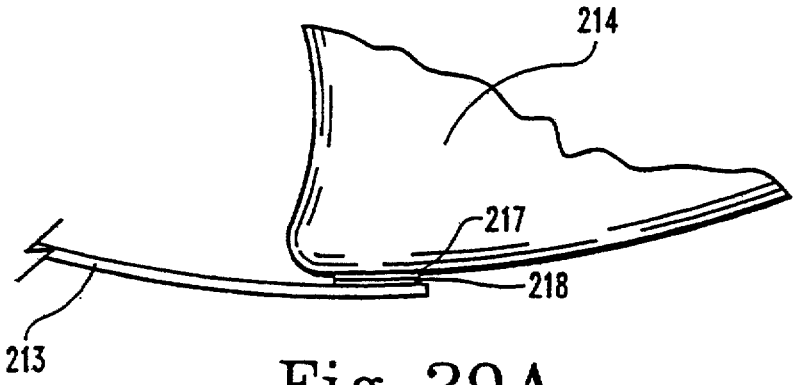
FIG. 29A is a partial, top plan view of the FIG. 29 alternative attachment arrangement.

Referring to FIG. 29, one such variation as illustrated is to eliminate the pouch and use a stretch fabric sleeve 213 to secure the wing 214 around the back side of the upper arm of the cyclist. The FIG. 29 embodiment is similar to the FIG. 7 embodiment except for the style and geometry of the respective and corresponding wedge-shaped arm wings. Wing 214 is identical in every respect to wing 184 except for the securement approach. The opposite edges 215 and 216 of the stretch fabric sleeve 213 are secured along the side surfaces adjacent the front (forward-facing surface 214*a*) of wing 214. The means of securement may be by a sewn attachment which is permanent so that the wing and sleeve simply slide up over the arm. Alternatively one side may be fixed and the other side adapted with two mating strips 217 and 218 of VELCRO so that the sleeve can be undone, wrapped around the arm and reattached. FIG. 29A is a partial top plan view showing the two matching VELCRO strips. Strip 217 is securely attached to the side of wing 214 and strip 218 is securely attached to the end of sleeve 213.

Figure 30:
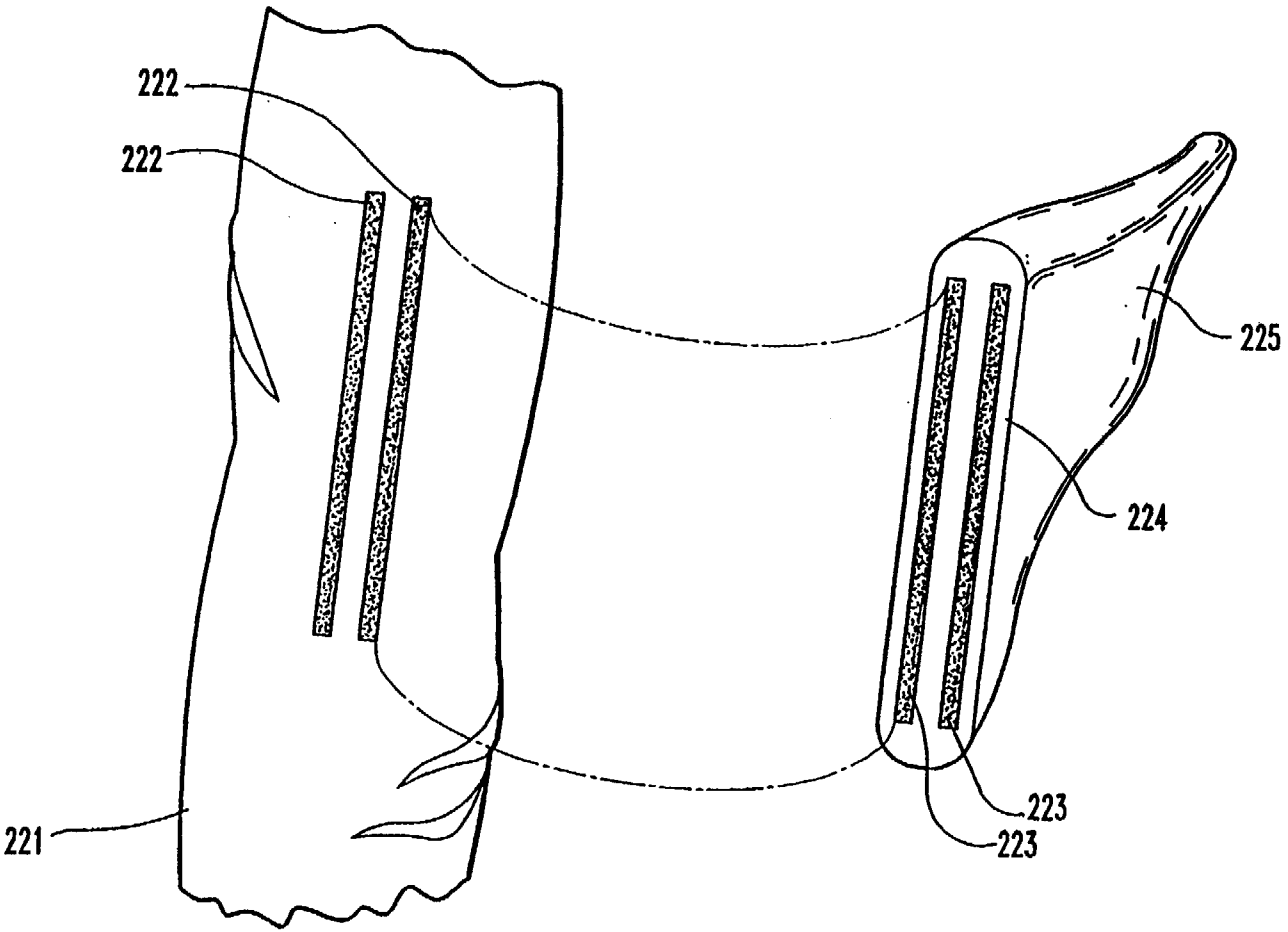
FIG. 30 is an exploded view of the backside of the left sleeve and the front surface of the aerodynamic wing of FIG. 24 illustrating a still further alternative attachment concept according to the present invention.

Another option as illustrated in FIG. 30 is to fit the back side (rear surface) of the jersey sleeve 221 with a panel or with strips 222 of VELCRO and a mating panel or strips 223 of VELCRO on the front surface 224 of wedge-shaped wing 225. The VELCRO strips can be sewn or adhesively attached and it is a simple step to attach the wing to the corresponding sleeve of the cyclist's jersey as well as to remove the wing when it is not to be used. There would of course be a wing on each sleeve and the wings are styled in accordance with wings 184 and 184*a* as in FIGS. 25–27.

Figure 31:
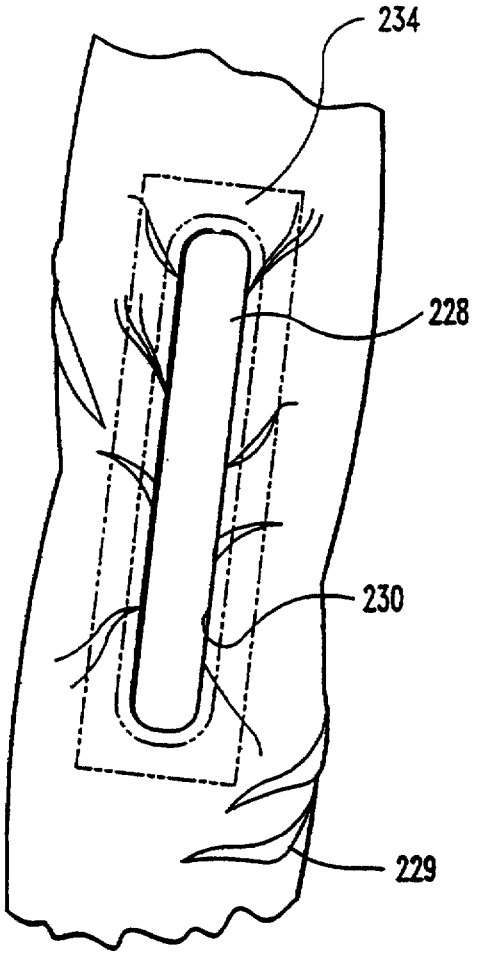
FIG. 31 is a partial perspective view of an alternative design for the sleeves of the FIG. 24 cyclist's jersey illustrating an elastic banded opening as a means to retain an aerodynamic wing in position.
Figure 31A:
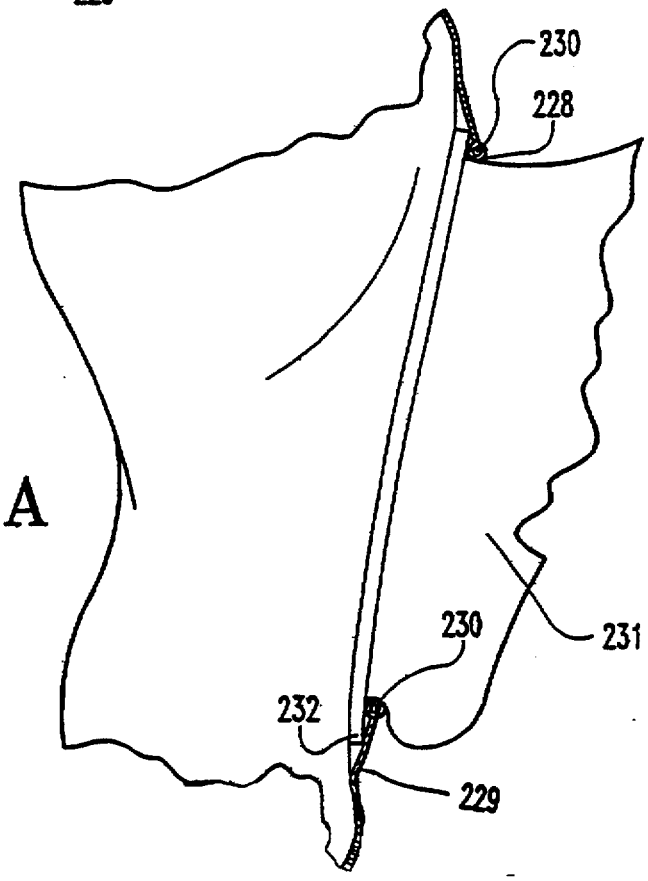
FIG. 31A is a side elevational view in partial section of a wing as installed into the FIG. 31 sleeve.

A still further option of the present invention as illustrated in FIGS. 31 and 31A is to create an opening 228 in the back of each sleeve 229 and sew into the sleeve around opening 228 a stiff elastic ring 230 or elastomeric band with sufficient elasticity to draw this opening inwardly into a relatively small aperture. The corresponding wing 231 is shaped with an outer peripheral lip 232 which is larger than the elastic ring sewn into the sleeve around the opening 228. By first inserting rear edge of the wing into the opening 228 and pushing the wing through the opening, the final form of FIG. 31A is created. The increasing size of the wing stretches the elastic ring 230 and its return, resilient force holds the wing in position against the arm of the cyclist. Lip 232 provides an abutment surface for the elastic ring 230 and for the elasticity of the sleeve to pull up against so as to pull the wing into position against the arm of the cyclist. In one version of the FIG. 31 embodiment a fabric panel 234 is provided so as to cover or close the opening 228 when the wing is not used.

Figure 32:
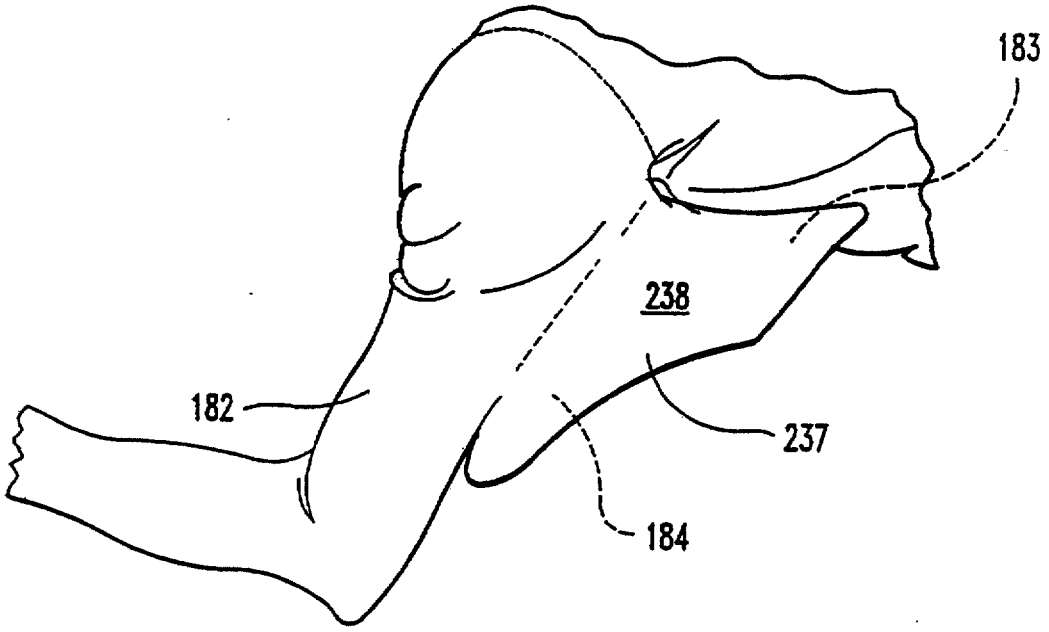
FIG. 32 is a partial side elevational view of the FIG. 24 cycling jersey modified with a rigid shell so as to create a hollow wing portion according to another embodiment of the present invention.

A still further embodiment of the present invention is illustrated in FIG. 32 which is similar to FIG. 24 as to the shape and position of the wing-portion relative to the upper arm of the cyclist. In the FIG. 24 embodiment a pouch was created in the sleeve so that a separate wing could be installed into the pouch. While this embodiment allows the wing to be a removable piece for each corresponding sleeve, it is unlikely that the jersey would be used without the wing since an empty pouch would create an aerodynamic inefficiency.

In the FIG. 32 embodiment what appears to be a separate wing inserted into a flexible fabric pouch is in fact a hollow, rigid or stiff shell 237 which is created in one embodiment of the present invention by applying an epoxy resin layer 238 onto the fabric pouch 183 which is shaped by the insertion of wing 184. With the wing 184 properly inserted into the pouch 183 and correctly aligned relative to the sleeve of the jersey, a layer of epoxy resin is carefully brushed onto all outer surfaces of the fabric pouch, but not onto the sleeve 182. This layer of epoxy resin is brushed on smoothly and applied with a uniform thickness. The result, once the epoxy resin sets up and cures, is a rigid shell form that very accurately matches or simulates the entire geometry of wing 184. The wing is then removed from the interior of the pouch, through the sleeve, and what is left is a rigid and hollow shell as an integral, unitary extension of the sleeve. This rigid and hollow shell is virtually identical in size and geometry to the wing which is created when wing 184 is inserted into the fabric pouch. This same configuration is created for the right sleeve using as a mold form wing 184*a*. As an integral part of the jersey, there is nothing for the cyclist to do but simply put on the jersey and the upper arms immediately become aerodynamic wings which reduce wind drag.

In a related embodiment of FIG. 32 the rigid and hollow shell 237 is created by an injection molding process wherein the fabric pouch of the sleeve is placed over the corresponding wing which is used as the male die portion of the molding process. A split block mold (female) is then placed over the wing form and a liquid (molten) molding compound is injected into the split block mold. The compound fuses to the fibers of the fabric pouch and a rigid and hollow shell is created when the compound cures (cools). In one variation the molding compound is nylon.

In a still further related embodiment of FIG. 32, the rigid and hollow shell 237 is created by a vacuum forming process. A thermoforming compound is shaped over the mold form of the wing within the pouch by conventional vacuum forming techniques. The heating of the compound as it is shaped over the wing fuses the compound to the fibers of the fabric pouch.

Figure 33:
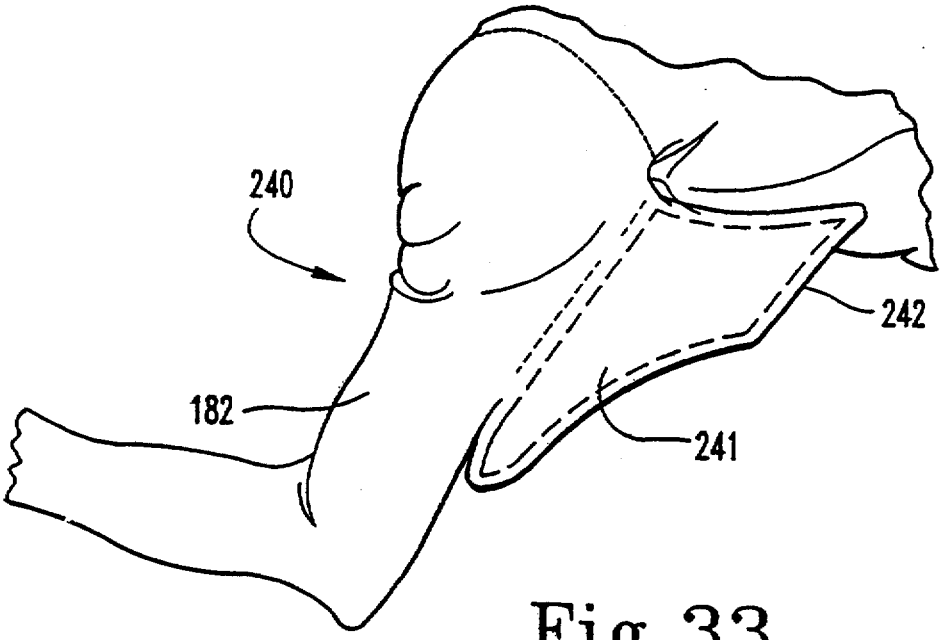
FIG. 33 is a partial side elevational view of the FIG. 24 cycling jersey modified with an inflatable air bladder in each sleeve pouch.

A still further embodiment of the present invention as illustrated in FIG. 33 is to create a jersey 240 with an inflatable bladder 241 positioned within a shaped pouch 242 in each sleeve 182. In one version this bladder operates in a manner similar to the "PUMP" athletic shoes by REEBOK. In another version the bladder is inflated much like an air mattress.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A wind drag reducer for a cyclist comprising:

an aerodynamic wedge-shaped main body member for reducing wind drag having a front surface, opposite side surfaces converging to a common rear edge, a top surface and a bottom surface; and positioning means attached to said main body member for securing the main body member to an arm of the cyclist.

2. In combination:

a left arm wind drag reducer for a cyclist comprising:

(a) an aerodynamic wedge-shaped main body member for reducing wind drag having a front surface, opposite side surfaces converging to a common rear edge, a top surface and a bottom surface; and (b) positioning means attached to said main body member for securing the main body member to a left arm of the cyclist; and a right arm wind drag reducer for said cyclist comprising:

(a) an aerodynamic wedge-shaped main body member for reducing wind drag having a front surface, opposite side surfaces converging to a common rear edge, a top surface and a bottom surface; and (b) positioning means attached to said main body member for securing the main body member to a right arm of the cyclist.

3. A wind drag reducer for placement adjacent a posterior side of an upper arm of a cyclist comprising:

an aerodynamic main body member for reducing wind drag having a generally triangular lateral cross-sectional shape, a forward-facing surface and a pair of opposite side surfaces converging together from adjacent said forward-facing surface to define a rear edge; and positioning means attached to said main body member for securing the main body member to the posterior side of the upper arm of the cyclist.

4. A wind drag reducer for placement adjacent a rearwardly facing portion of an arm of a speed sport athlete such as a cyclist or skater comprises:

an aerodynamic main body member for reducing wind drag having a forward-facing surface and a pair of opposite side surfaces converging together from adjacent said forward-facing surface to define a rear edge; and attachment means for securing the main body member to the rearwardly facing portion of the athlete's arm.

5. A wind drag reducer for a cyclist comprising:

an aerodynamic wedge-shaped main body member for reducing wind drag having a front surface, opposite side surfaces, a top surface and a bottom surface; and positioning means attached to said main body member for securing the main body member to an arm of the cyclist, wherein said positioning means is a stretch fabric sleeve.

6. A wind drag reducer for a cyclist comprising:

an aerodynamic main body member for reducing wind drag having a generally triangular lateral cross-sectional shape, a forward-facing surface and a pair of opposite side surfaces converging together from an adjacent said forward-facing surface to define a rear edge; and positioning means attached to said main body member for securing the main body member to an arm of the cyclist, wherein said positioning means is a stretch fabric sleeve.

7. A wind drag reducer for positioning adjacent an upper arm of a cyclist comprising:

an aerodynamic wedge-shaped main body member for reducing wind drag having a front surface, opposite side surfaces which converge to a common rear edge, a top surface and a bottom surface; and an arm member designed and arranged to extend around a portion of the upper arm of the cyclist, said arm member engaged with said main body member for pulling said main body member into position adjacent the upper arm of the cyclist.

8. In combination:

a left arm wind drag reducer for placement adjacent an upper left arm of a cyclist comprising:

(a) an aerodynamic wedge-shaped main body member for reducing wind drag having a front surface, opposite side surfaces converging to a common rear edge, a top surface and a bottom surface; and (b) an arm member designed and arranged to extend around a portion of the upper left arm of the cyclist, said arm member engaged with said main body member for pulling said main body member into position adjacent the upper left arm of the cyclist; and a right arm wind drag reducer for placement adjacent an upper right arm of a cyclist comprising:

(a) an aerodynamic wedge-shaped main body member for reducing wind drag having a front surface, opposite side surfaces converging to a common rear edge, a top surface and a bottom surface; and (b) an arm member designed and arranged to extend around a portion of the upper right arm of the cyclist, said arm member engaged with said main body member for pulling said main body member into position adjacent the upper right arm of the cyclist.

9. A wind drag reducer for positioning adjacent an upper arm of a cyclist comprising:

an aerodynamic main body member for reducing wind drag having a generally triangular lateral cross-sectional shape, a forward-facing surface and a pair of opposite side surfaces converging together from adjacent said forward-facing surface to define a common rear edge; and an arm member designed and arranged to extend around a portion of the upper arm of the cyclist, said arm member engaged with said main body member for pulling said main body member into position adjacent the upper arm of the cyclist.

10. A wind drag reducer kit for a skater, said skater wearing a pair of skating boots, said kit comprising:

a pair of wedge-shaped calf members, each calf member having opposite sides converging into a rear edge;

first positioning means cooperating with said calf members for securing each calf member to the skater;

a pair of wedge-shaped boot members, each boot member having opposite sides converging into a rear edge; and second positioning means cooperating with said boot members for securing each boot member to a corresponding skating boot of said pair of skating boots.

11. The wind drag reducer kit of claim 10 wherein said first positioning means includes a separate stretch fabric sleeve for each calf member.

12. The wind drag reducer kit of claim 11 wherein each of said calf members is designed and arranged to fit up against a corresponding calf of the skater.

13. The wind drag reducer kit of claim 11 wherein said second positioning means includes a separate stretch boot cover for each skating boot.

14. The wind drag reducer kit of claim 10 wherein each one of said pair of wedge-shaped calf members is a hollow plastic form which is covered in a vinyl fabric.

15. The wind drag reducer kit of claim 14 wherein said first positioning means includes a separate stretch fabric sleeve for each calf member.

16. The wind drag reducer kit of claim 10 wherein each one of said pair of wedge-shaped boot members is a foamed shape.

17. The wind drag reducer kit of claim 16 wherein said second positioning means includes a separate stretch boot cover for each skating boot.

18. An aerodynamic enhancement kit for positioning onto portions of the user's anatomy comprising:

a rear spoiler board having a contoured and tapered shape;

attachment means cooperating with said board for securing the board to the user;

a left arm wind drag reducer including a wedge-shaped main body member and positioning means attached to the main body member for securing the member to the user; and a right arm wind drag reducer including a wedge-shaped main body member and positioning means attached to the main body member for securing the member to the user.

19. A wind drag reducer for positioning on a rearwardly facing portion of an arm of a speed sport athlete such as a cyclist or skater comprising:

an aerodynamic main body member for reducing wind drag having a forward-facing surface and a pair of opposite side surfaces converging together from adjacent said forward-facing surface to define a common rear edge; and a positioning member designed and arranged to extend around a portion of the arm of the athlete, said positioning member being engaged with said main body for pulling said main body member into position adjacent the rearwardly facing portion of the arm of the athlete.

* * * * *